US006261995B1

(12) United States Patent
Nakajima et al.

(10) Patent No.: US 6,261,995 B1
(45) Date of Patent: Jul. 17, 2001

(54) THERMAL TRANSFER INTERMEDIATE MATERIAL, A THERMAL TRANSFER IMAGE FORMING MATERIAL AND A THERMAL TRANSFER RECORDING MATERIAL SET

(75) Inventors: Atsushi Nakajima; Katsuya Kishinami; Sota Kawakami; Kiyoshi Akagi; Katsuyuki Takeda, all of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/312,981

(22) Filed: May 17, 1999

(30) Foreign Application Priority Data

May 21, 1998 (JP) ..... 10-139879
Aug. 25, 1998 (JP) ..... 10-238654
Sep. 10, 1998 (JP) ..... 10-256680
Dec. 10, 1998 (JP) ..... 10-351154

(51) Int. Cl.[7] ..... B41M 5/035; B41M 5/38
(52) U.S. Cl. ..... 503/227; 428/195; 428/409
(58) Field of Search ..... 8/471; 428/913, 428/914, 409; 156/235; 503/227

(56) References Cited

U.S. PATENT DOCUMENTS 5,294,592 * 3/1994 Noguchi et al. ..... 503/227

FOREIGN PATENT DOCUMENTS 0 678 397 A 10/1995 (EP) .
0 800 927 A 10/1997 (EP) .

OTHER PUBLICATIONS

Patent Abstracts of Japan, vol. 1998, No. 08, 30 Jun. 1998 of JP 10 067180A (OJI Paper Co. Ltd.), 10 Mar. 1998.

Patent Abstracts of Japan, vol. 1999, No. 03, 31 Mar. 1999 of JP 10 329438A (Toray Ind Inc.), 15 Dec. 1998.

* cited by examiner

*Primary Examiner*—Bruce H. Hess
(74) *Attorney, Agent, or Firm*—Frishauf, Holtz, Goodman, Langer & Chick, P.C.

(57) ABSTRACT

An intermadiate transfer material;

to which an image is transferred from a thermal transfer image forming material by thermal transfer;

which transfers said transferred image to a final support by thermal transfer; comprising:

a support and a receiving layer to which said image is transferred from said thermal transfer image forming material, wherein said intermediate transfer material comprises a layer or a support of which surface specific resistance is more than $2\times10^9$ to not more than $10^{12}$ $\Omega/m^2$ under the relative humidity not more than 80%.

20 Claims, 1 Drawing Sheet

$\theta_2 < 180^\circ \quad \theta_1 < \theta_2$

THERMAL TRANSFER INTERMEDIATE MATERIAL, A THERMAL TRANSFER IMAGE FORMING MATERIAL AND A THERMAL TRANSFER RECORDING MATERIAL SET

FIELD OF THE INVENTION

The present invention relates to an intermediate transfer material used in a thermal transfer recording method, a thermal transfer image forming material, a thermal transfer recording material set in combination of those and an image forming method using the same.

BACKGROUND OF THE INVENTION

As a conventional thermal image transfer technique there is a method comprising bringing a recording material having on a substrate a layer containing a heat fusible or heat sublimable dye in close contact with an image receiving material, and applying heat source from the recording material side by means of a thermal head or an electric head controlled by an electric signal to transfer an image to the image receiving material.

Thermal transfer recording has advantages such as no noise, maintenance-free, low cost, ease of color image formation and digital recording capability, and is applied in various fields such as printers, recorders, facsimile and computer terminals.

Technique of printers employing a thermal head has been markedly progressed. As a printing method giving high resolution image and enabling variable contrast recording with area contrast alone, there is proposed a sub-scanning separation method disclosed in Japanese Patent Publication Open to Pulic Inspection (hereinafter referred to as JP-A) Nos. 4-19163 and 5-155057 or a heat assembling method disclosed in "Denshishashin Gakkai Nenjitaikai Jun. 6, 1992 Yokoshu".

Recently, in the medical or printing fields requiring a high resolution image, there is proposed a dry recording method employing a high-power light source such as a laser. The example is disclosed in JP-A No. 59-143659.

An intermediate transfer material usable for a laser thermal transfer method is disclosed in JP-A No. 10-71775. In this embodiment, to prevent peeling static charge of a recording material, the surface specific resistance of a back coat is preferably to be not more than $2\times10^9\Omega$. However, in fact, with this surface specific resistance, it is impossible to sufficiently prevent static charge occuring in transportation in an apparatus, and it was found that electrostatic adsorption at teflon processed portion equipped at transportation guide to prevent abration marks occurs and causes transpotation trouble. The transpotation trouble that gives a damage to a laser image with high resolution power has an unpermitted problem for a practical use. Furthermore, in cases where a thermal transfer image forming material containing a light-heat converting layer is manufactured, coatability is occasionally a problem caused by the difference between property of the light-heat converting layer and that of other layer.

SUMMARY OF THE INVENTION

Accordingly, in view of the foregoing, the present invention was accomplished. An object of the invention is to provide the intrermediate transfer material with improved peeling static charge and transportation property, specifically, to provide the intrermediate transfer material suitable for heat mode recording in which the intermediate transfer material is brought into close contact with recording material and then recording is carried out. Other object of the invention is to provide an improved coatability of the light-heat converting layer. Furthermore, other object of the invention is to provide the laser-melt thermal transfer recording material which satisfies the uniformity of image density of each first color and second color in wide proper exposure condition region (energy region where solid density is uniform and ablation does not occur). Using said laser-melt thermal transfer recording material, when recording plural colors, to estalish the proper exposure condition is easy. Inventors of the present invention found later mentioned fact after the repetition of examinations and applied this invention. That is, by establishing the absorption of the light-heat converting layer with every color of ink, difficulty on the operation of establishing the proper exposure condition when exposing is solved, and stable exposing condition can be obtained for every color, as a result, wide optimum recording condition in respect to ablation and sensitivity can be obtained.

BRIEF DESCRIPTION OF MARKS

Figure 1:
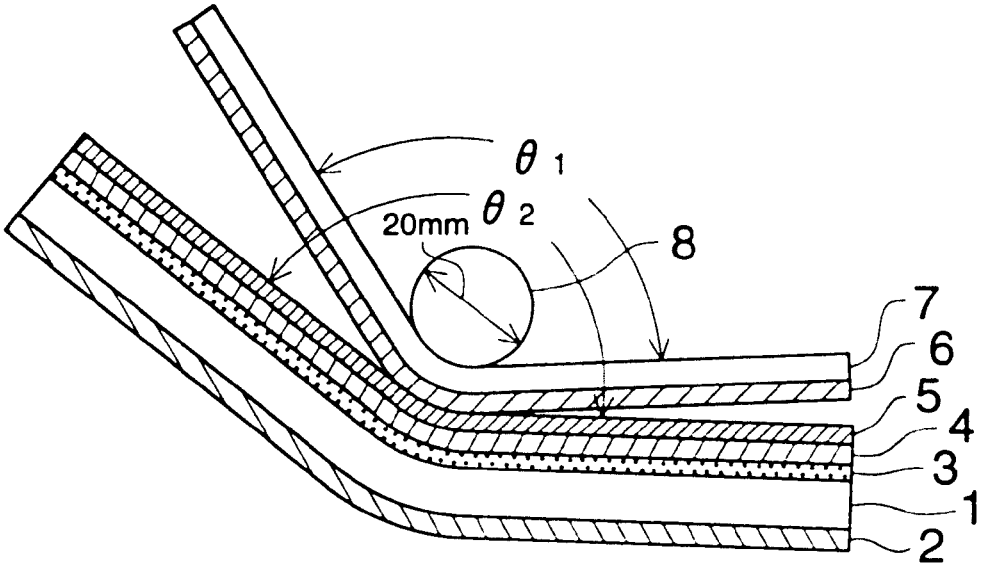
FIG. 1 illustrates an outline of a cross-sectional view indicating the peeling condition when producing the recording material according to the present invention by sticking-peeling.

1 Support
2 Back coat layer
3 Cushion layer
4 Light-heat converting layer
5 Ink layer
6 Releasing layer
7 Temporary support
8 Roller

DETAILED DESCRIPTION OF THE INVENTION

Above objects of the invention could be attained by the following methods.

1. An intermadiate transfer material; to which an image is transferred from a thermal transfer image forming material by thermal transfer; which transfers said transferred image to a final support by thermal transfer; comprising: a support and a receiving layer to which said image is transferred from said thermal transfer image forming material, wherein said intermediate transfer material comprises a layer or a support of which surface specific resistance is more than $2\times10^9$ to not more than $10^{12}$ $\Omega/m^2$ under the relative humidity of not more than 80%.
2. Said intermediate transfer material of item 1, wherein said intermediate transfer material comprises a heat-plasticized cushion layer between said support and said receiving layer, and thickness of said heat-plasticized cushion layer is not less than 15 $\mu$m.
3. Said intermediate transfer material of item 1, wherein said receiving layer has protrusions of 2 to 5 $\mu$m, and said intermediate transfer material comprises a back coat layer on an opposite side to said receiving layer, and said back coat has protrusions of not less than 5 $\mu$m to not more than 15 $\mu$m.

4. Said intermediate transfer material of item 1, wherein said receiving layer has the protrusions of 2 to 5 $\mu$m, and said intermediate transfer material comprises the back coat layer on an opposite side to said receiving layer, and a smooster value of said back coat layer is not more than 300 mmHg.

5. Said intermediate transfer material of item 1, wherein a layer, in said intermediate transfer material, of which surface specific resistance is more than $2\times10^9$ to not more than $10^{12}$ $\Omega/m^2$ under the relative humidity of not more than 80% contains metal fine particles.

6. Said intermediate transfer material of item 1, wherein the layer, in said intermediate transfer material, of which surface specific resistance is more than $2\times10^9$ to not more than $10^{12}$ $\Omega/m^2$ under the relative humidity of not more than 80% contains at least one of carbon black fine particles, graphite fine particles and tin oxide fine particles.

7. Said intermediate transfer material of item 1, wherein said thermal transfer is a laser thermal transfer.

8. A thermal transfer image forming material in which an image is transferred by thermal transfer comprising: a support, an ink layer and a light-heat converting layer between said ink layer and said support, wherein said light-heat converting layer contains 5 to 60 wt % of a light-heat converting agent and 0.01 to 10 wt % of a fluorine containing surfactant, when total weight of said light-heat converting layer represents 100 wt %.

9. Said thermal transfer image forming material of item 8, wherein said fluorine containing surfactant contains a nonionic perfluorocarbon group.

10. Said thermal transfer image forming material of item 8, wherein said thermal transfer is a laser thermal transfer.

11. Said thermal transfer image forming material of item 8, wherein said light-heat converting agent is a near infrared ray absorbing dye of which absorbance is 0.5 to 1.5 at 830 nm.

12. Said thermal transfer image forming material of item 8, wherein said near infrared ray absorbing dye is a carbon black.

13. Said thermal transfer image forming material of item 8, wherein surface tension of a non-polar component of a coating solution of said light-heat converting layer is not more than 28 dyn/cm, or the surface tension of a polar component of the coating solution of said light-heat converting layer is not more than 3 dyn/cm.

14. Said thermal transfer image forming material of item 8, wherein contact angle (measured 60 seconds later after coating) of a coating solution of said light-heat converting layer to an under layer of said light-heat converting layer is not more than 55°.

15. Said thermal transfer image forming material of item 8, wherein viscosity of said coating solution of said light-heat converting layer at shear rate of $10^{-5}$ (1/s) is not less than 400 cp.

16. Said thermal transfer image forming material of item 8, wherein said thermal transfer image forming material contains a cushion layer.

17. A thermal transfer recording material set comprising:

(i) at least two thermal transfer image forming materials comprising: supports, ink layers and light-heat converting layers between said ink layers and and said supports;

(ii) an intermediate transfer material, to which an image is transferred from said thermal transfer image forming material by thermal transfer; which transfers said transferred image to a final support by thermal transfer; comprising: a support and a receiving layer to which said image is transferred from said thermal transfer image forming materials, wherein said at least two thermal transfer image forming materials contain said ink layers having different colors, and wherein said intermediate transfer material comprises a layer or a support of which surface specific resistance is more than $2\times10^9$ to not more than $10^{12}$ $\Omega/m^2$ under the relative humidity of not more than 80%.

18. Said thermal transfer recording material set of item 17, wherein said light-heat converting layer contains 5 to 60 wt % of a light-heat converting agent and 0.01 to 10 wt % of a fluorine containing surfactant, when total weight of said light-heat converting layer represents 100 wt %.

19. Said thermal transfer recording material set of item 17, wherein in said at least two thermal transfer image forming materials containing said ink layers having different colors, absorption of a laser beam light of said light-heat converting layers of said thermal transfer image forming materials is different.

20. Said thermal transfer recording material set of item 19, wherein one of said at least two thermal transfer image forming materials each composed of said ink layers having different colors is a thermal transfer image forming material composed of the ink layer of black, and other is a thermal transfer image forming material composed of the ink layer of color other than black; absorbance of said laser beam light of said light-heat converting layer of said thermal transfer image forming material composed of the ink layer of black is larger than that of said light-heat converting layer of said thermal transfer image forming material composed of the ink layer of color other than black.

The following items are important in the present invention.

(i) An intermediate transfer material used in heat-transferring an image transferred by a thermal transfer recording method onto a final support, thereafter forming a final image on said final support by peeling; wherein said intermediate transfer material comprises a layer or a support of which surface specific resistance is $10^8$ to $10^{12}$ $\Omega/m^2$ under the relative humidity of not more than 80%.

(ii) An image forming method comprising the steps:

a step for transferring an image by a thermal transfer recording method onto an intermediate transfer material having a layer or a support of which surface specific resistance is $10^8$to $10^{12}$ $\Omega/m^2$ under the relative humidity of not more than 80%, a step for heat-transferring said image formed on said intermediate transfer medium onto a final support, a step for obtaining a final image by peeling off said intermediate transfer medium from said final support.

(iii) The image forming method of item (ii), wherein an image recording surface of said intermediate transfer medium after transferring said image is transported in contact with at least one of an insulated transporting guide and a transporting roll.

(iv) A light-heat converting heat mode recording material comprising a support having thereon a light-heat converting layer containing a light-heat converting agent in an amount of 5 to 60 wt % and a fluorine-containing surfactant in an amount of 0.01 to 10 wt %.

(v) The light-heat converting heat mode recording material of item (iv), wherein surface tension of a non-polar component of a coating solution of said light-heat converting layer is not more than 28 dyn/cm, or surface tension of a polar component of the coating solution of said light-heat converting layer is not more than 3 dyn/cm.

(vi) The light-heat converting heat mode recording material of item (iv) or (v), wherein contact angle (measured 60 seconds later after coating) of said coating solution of said light-heat converting layer to an under layer of said light-heat converting layer is not more than 55°.

(vii) The light-heat converting heat mode recording material of item (iv), (v) or (vi), wherein viscosity of said coating solution of said light-heat converting layer at shear rate of $10^{-5}$ (1/s) of said coating solution of said light-heat converting layer is not less than 400 cp.

(viii) A method for producing a light-heat converting heat mode recording material comprising the steps:

a step for sticking a support having thereon a colorant layer and a light-heat converting layer in this order with another support having thereon a cushion layer;

a step for transferring the colorant layer and the light-heat converting layer peeled off to the support having thereon the cushion layer;

wherein content ratio of a light-heat converting agent in said light-heat converting layer is 5 to 60 wt % and that of a fluorine-containing surfactant is 0.01 to 10 wt %.

(ix) The method for producing the light-heat converting heat mode recording material of item (viii), wherein surface tension of a non-polar component of a coating solution of said light-heat converting layer is not more than 28 dyn/cm, or surface tension of a polar component is of the coating solution of said light-heat converting layer is not more than 3 dyn/cm.

(x) The method for producing the light-heat converting heat mode recording material of item (viii) or (ix), wherein contact angle (measured 60 seconds later after coating) of said coating solution of said light-heat converting layer to an under layer of said light-heat converting layer is not more than 55°.

(xi) The method for producing the light-heat converting heat mode recording material of item (viii), (ix) or (x), wherein viscosity of said coating solution of said light-heat converting layer at shear rate of $10^{-5}$ (1/s) of said coating solution of said light-heat converting layer is not less than 400 cp.

(xii) A laser-melt thermal transfer recording material used in laser-melt thermal transfer recording method comprising the steps:

a step for bringing a laser-melt thermal transfer recording material having a light-heat converting layer and an ink layer into close contact with a receiving material;

a step for imagewise exposing said laser-melt thermal transfer recording material brought into close contact with said receiving material to a laser beam light;

a step for recording a monochromatically colored image by allowing said ink layer to be transferred to said receiving material by peeling off said laser-melt thermal transfer recording material from said receiving material;

a step for forming a plurally colored image by superposing plural colors by repeatedly recording a monochromatically colored image in similar manner to the above using a laser-melt thermal transfer recording material having an another colored ink layer;

wherein said laser-melt thermal transfer recording material is characterized in that absorption of light-heat converting layer of said recording material per unit coating weight at wavelength of laser beam light is combined so as to be substantially different by color.

(xiii) Said laser-melt thermal transfer recording material of item (xii), wherein said light-heat converting layer contains a binder and a light-heat converting agent, and temprature where weight decreasing ratio of said binder measured by thermal decomposition measurement using TGA method under the condition of nitrogen atmosphere and temperature raising rate of 10° C./min. is to be 50% is not less than 360° C.

(xiv) Said laser-melt thermal transfer recording material of item (xii) or (xiii), wherein said light-heat converting agent is at least one compound selected from carbon black, graphite and colloidal silver.

(xv) A laser-melt thermal transfer recording method comprising the steps:

a step for bringing a laser-melt thermal transfer recording material having a light-heat converting layer and an ink layer into close contact with a receiving material;

a step for imagewise exposing said laser-melt thermal transfer recording material brought into close contact with said receiving material to a laser beam light;

a step for recording a monochromatically colored image by allowing said ink layer to be transferred to said receiving material by peeling off said laser-melt thermal transfer recording material from said receiving material;

a step for forming a plurally colored image by superposing plural colors by repeatedly recording a monochromatically colored image in similar manner to the above using a laser-melt thermal transfer recording material having an another colored ink layer;

wherein said laser-melt thermal transfer recording material is characterized in that absorption of light-heat converting layers of laser-melt thermal transfer recording materials per unit coating weight at wavelength of laser beam light are combined so as to be substantially different by color.

(xvi) Said laser-melt thermal transfer recording method of item (xv), wherein recording an image begins with a laser-melt thermal transfer recording medium comprising color corresponding to said light-heat converting layer of which absorption per unit coating weight is established to be the largest.

Next, the invention will be explained in detail.

Inventors of the present invention found later mentioned fact after the repetition of examinations and applied this invention. That is, as the intermediate transfer material used in the thermal transfer method, employing a layer or a support of which surface specific resistance is $2\times10^{9}$ to $10^{12}$ $\Omega/m^2$ under the relative humidity of not more than 80%, peeling static charge is improved and transportation is carried out stably in any circumstance, furthermore, friction static charge in transportation of various materials in an apparatus can be prevented. As there has been a problem in the coatability of the light-heat converting layer in the light-heat converting type heat mode recording material in which the thermal transfer was conducted by light-heat converting, the improvement of the coatability of the light-heat converting layer has been desired. However, addition of a fluorine-containing surfactant into the light-heat converting layer could change the characteristic of the coating solution of the light-heat converting layer to result in improvement of the coatability and output of an image high quality. That is, by adding the fluorine-containing surfactant, viscosity of the coating solution of the light-heat converting layer is slightly increased and its surface tension tends to decrease, therefore its contact angle to the under layer is decreased. Thus, when the coating solution of the light-heat converting layer is coated, repellency of the solution is largely decreased so that an excellent coatability can be obtained.

The intermediate transfer material, recording material and image forming method will be explained in this order below. In the present invention, the thermal transfer includes the thermal transfer by a laser exposure and the thermal transfer by heat employing a thermal head, etc. The thermal transfer by the laser includes a laser ablation transfer and laser melting transfer in which a colorant layer is transferred by ablation and melting, and includes a laser sublimation transfer in which only a dye (or dyes) in the colorant layer is transferred by sublimation.

<Intermediate Transfer Material>

An intermediate transfer material according to the present invention is characterized in that it comprises a layer or a support of which surface specific resistance is more than $2\times10^9$ to not more than $10^{12}$ $\Omega/m^2$ under the relative humidity of not more than 80%. It is preferred that the surface specific resistance is more than $10^{10}$ to not more than $10^{12}$ $\Omega/m^2$ under the relative humidity of not more than 80%. As said layer, any layer cited below will be acceptable, but a layer which remains together with the intermediate material after an image is transferred to a final support is preferred, and a back coat layer is specifically preferred. It is preferred that the intermediate transfer material fundamentally comprises a support having a back coat layer on a surface of one side thereof and a cushion layer and a receiving layer in this order on a surface of the other side thereof. A peeling layer may be provided between the cushion layer and the receiving layer. The surface specific resistance of a support, a cushion layer such as a thermoplasticized cushion layer, etc., and a peeling layer other than the back coat layer may be in the above-mentioned range.

The support may be any support, as long as it has excellent dimensional stability and heat resistance in forming an image. As the support, is used, for example, a film or sheet disclosed on page 2, lower left column, lines 12 to 18 of JP-A No. 63-193886. For example, polyethyleneterephthalate (PET), polyethylenenaphthalate (PEN), polypropylene (PP), polyimide, polyethylene or coated paper laminated with polyethylene or polypropylene can be used. The support has preferably stiffness or flexibility suitable for transportation. The thickness of the support is preferably 25 to 300 $\mu$m, and more preferably 50 to 200 $\mu$m, specifically preferably 50 to 125 $\mu$m.

To attain the surface specific resistance of more than $2\times10^9$ to not more than $10^{12}$ $\Omega/m^2$ under the relative humidity of not more than 80%, an antistatic agent is preferably used. The antistatic agent includes a cationic, anionic or nonionic surfactant, a polymer antistatic agent, conductive fine particles and compounds described on pages 875 and 876 of "11290 Kagaku Shohin", Kagakukogyo Nipposha.

To attain the surface specific resistance of the back coat layer in the fixed range of the present invention, the antistatic agent contained in the back coat layer includes conductive fine particles such as carbon black and graphite, metal oxides such as tin oxide, zinc oxide, or titanium oxide, and organic semiconductors. Particularly, the conductive fine particles are free from separation from the back coat layer and gives a stable antistatic effect independent of ambient atmosphere such as temperature.

To record an image in bringing the intermediate transfer material according to the invention in strict contact with the recording material, it is preferable to employ an appropriate smooster value (suction pressure) by roughening the back coat layer.

The appropriate smooster value is obtained by the following method:

(a) after the back coat layer is provided, the layer is subjected to embossing treatment whereby the surface is roughened, (b) the back coat layer surface is roughened by incorporation of a matting agent to the back coat layer, or (c) using a support previously roughened as a support, on this support was coated less roughened back coat layer than the previously roughened support, and thus the roughened back coat layer was obtained.

Particularly in the thermal transfer recording method requiring a precise image, a film or sheet having a smooth surface is preferably used as the support, and therefore, the necessary surface suction pressure is obtained preferably by method (b). In the invention, the suction pressure is preferably not more than 300 mmHg, more preferably not more than 150 mmHg.

The suction pressure of the back coat layer surface can be measured employing a smooster SM-6B (produced by Toei Denkikogyo Co., Ltd.).

The binder used in the back coat layer includes a polymer such as gelatin, polyvinyl alcohol, methylcellulose, nitrocellulose, acetylcellulose, an aromatic polyamide resin, a silicone resin, an epoxy resin, an alkyd resin, a phenol resin, a melamine resin, a fluorine-containing resin, a polyimide resin, an urethane resin, an acryl resin, an urethane modified silicone resin, a polyethylene resin, a polypropylene resin, a teflon resin, a polyvinyl butyral resin, a polyvinyl chloride resin, polyvinyl acetate, polycarbonate, an organic boron compound, an aromatic ester, a fluorinated polyurethane, a polyether sulfone, a polyester resin and a polyamide resin, etc.

It is effective for prevention of separation of the matting agent from the back coat layer and improved anti-scratch of the back coat layer to use a cross-linkable binder in the back coat layer and cross-link the binder. It is also effective for blocking during storage.

According to characteristics of a cross-linking agent used, the cross-linking is carried out by heat, an active ray, pressure or combinations of these, but with no special limitation. An adhesive layer may be provided on the back coat layer side of the support to give an adhesion property to the support.

The matting agent preferably used in the back coat layer includes organic or inorganic fine particles. The organic matting agent includes fine particles such as polymethyl methacrylate (PMMA), polystyrene, polyethylene, polypropylene or other radical polymerization polymers and polycondensation polymer fine particles such as polyester and polycarbonate.

The coating weight of the back coat layer is preferably 0.5 to 3 g/m$^2$. The coating weight less than 0.5 g/m$^2$ results in unstable coatability and separation of the matting agent from the back coat layer. Since the coating weight of more than 3 g/m$^2$ requires a matting agent of large particle size, the image receiving layer is likely to be embossed by the back coat layer during storage and particularly image recording failure or image unevenness is likely to occur in a thin layer heat fusion transfer recording method comprising transfer recording of a thin layer colorant layer.

The number average particle size of the matting agent is preferably 2.5 $\mu$m or more larger than the thickness of the back coat layer containing only a binder resin, and more preferably 5 μm or more larger than the thickness of the back coat layer containing only the binder resin. Further, the number average particle size of the matting agent is preferably 15 μm or less than the thickness of the back coat layer containing only the binder resin. The back coat layer containing a matting agent having a particle size of 5 μm or more, prefarably 8 μm or more, in an amount of not less than 5 $mg/m^2$ minimizes foreign matter problems. It has been proved that the matting agent having a value obtained by dividing standard deviation by the number average particle size, $\sigma/r_n$ (variation coefficient of particle size) of 0.3 or less, which has a narrow particle size distribution, solves a problem which occurs caused by a matting agent of too large particle size and further can attain an intended object in a small amount. The variation coefficient is more preferably 0.15 or less.

The back coat layer preferably contains an antistatic agent in order to prevent foreign matter adherence due to frictional electrification caused during contact with a transport roller. Adding amount of the antistatic agent is preferably adjusted so that the surface specific resistance of the layer or the support which the intermediate transfer material comprises is to be more than $2\times10^9$ to not more than $10^{12}$ $\Omega/m^2$ under the relative humidity of not more than 80%.

The back coat layer may contain various surfactants, silicone oil or a releasing agent such as a fluorine-containing resin in order to have a releasing or coating property.

The cushion layer is preferably provided to improve to bring the intermediate transfer material according to the invention into close contact with the recording material. Said cushion layer is a layer having a cushion property. Elastic modulus or penetration can be employed as a measure of the cushion property herein referred to. The cushion layer having, for example, an elastic modulus of 1 to 250 $kg/mm^2$ or a penetration of 15 to 500, exhibits an excellent cushion property in forming a color proof image, but the desired cushion degree varies due to an intended use of the image. The penetration herein referred to is determined by JIS K2530-1976.

The cushion layer preferably comprises the material having heat plasticized property, for example, the preferable resins include an ethylene-vinyl acetate copolymer, an ethylene-ethyl acrylate copolymer, a polybutadiene resin, a styrene-butadiene copolymer (SBR), a styrene-ethylene-butene-styrene copolymer (SBES), an acrylonitrile-butadiene copolymer (NBR), a polyisoprene copolymer (IR), a styrene-isoprene copolymer (SIS), an acrylate copolymer, a polyester resin, a polyurethane resin, an acryl resin, a butyl rubber, a polynorbornene, a copolymer derived from ethylene and acrylic acid, a copolymer derived from ethylene and acrylic acid ester and a polystyrene. To give cushion property on the support, a material having low elastic modulus or a material having rubber elasticity can be used for the intermediate layer. Concretely, are cited natural rubber, acrylate rubber, butyl rubber, nitrile rubber, butadiene rubber, isoprene rubber, styrene-butadiene rubber, chloroprene rubber, urethane rubber, silicone rubber, acryl rubber, fluorine rubber, neoprene rubber, chlorosulfonated polyethylene, epichlorohydrin, EPDM (ethylene-propylene-diene rubber), elastomer such as urethane elastomer, etc., polyethylene, polypropylene, polybutadiene, polybutene, anti-shock ABS resin, polyurethane, ABS resin, acetate, cellulose acetate, amide resin, polytetrafluoroethylene, nitrocellulose, polystyrene, epoxy resin, phenol-formaldehyde resin, polyester, anti-shock acryl resin, styrene-butadiene copolymer, ethylene-vinylacetate copolymer, acrylonitrile-butadiene copolymer, vinylchloride-vinylacetate copolymer, polyvinylacetate, plasticizer containing vinylchloride resin, vinylidenechloride resin, polyvinylchloride, and polyvinylidenechloride having low elastic modulus. As a shape memory resin usable for the intermediate layer having the cushion property, are cited polynorbornene and styrene type hybrid polymer in which polybutadiene unit and polystyrene unit are combined.

Of these, one having a relative low molecular weight is likely to satisfy the inventive element, but is not limited in view of the components used.

The additives other than the described above can also give preferable properties to the cushion layer. These additives include a low melting point compound such as wax and a plasticizer such as phthalate, adipate, a glycol ester, a fatty acid ester, a phosphate, and chlorinated paraffin. Additives as described in "Purasuchikku oyobi gomu yo tenkazai jitsuyo binran", Kagaku Kogyosha (1970) can be used. Further, matting agent such as an acryl resin, various kinds of surfactants and defoaming agent such as a silicone compound can be added.

The addition amount of the additives may be an amount necessary to develop preferable properties with main components used in the cushion layer with no special limitations, but is preferably 10 weight %, more preferably 5 weight %, based on the total cushion layer weight.

The cushion layer is formed by dissolving or dispersing the compounds described above in a solvent and coating the resulting solution or dispersion on a support by means of a blade coater, a roller coater, a bar coater, a curtain coater or a gravure coater, or by hot-melt extrusion laminating.

The thickness of the cushion layer is preferably 15 μm or more, more preferably 20 μm or more. When an image is re-transferred onto another image receiving material (for example, coat paper or wood-free paper), the thickness of the cushion layer is preferably 30 μm or more. The cushion layer thickness of less than 15 μm results in transfer failure in re-transferring an image to the final image receiving layer and the cushion layer thickness is preferably not more than 200 μm, more preferably not more than 100 μm, specifically preferably not more than 50 μm.

The image receiving layer contains a binder and a matting agent, and optionally various additives. The binder includes an adhesive such as a polyvinyl acetate emulsion type adhesive, a chloroprene emulsion type adhesive or an epoxy resin type adhesive, a tackifying agent such as a natural rubber, chloroprene rubber, butyl rubber, polyacrylate, nitrile rubber, polysulfide, silicone rubber or a petroleum resin, a reclaimed rubber, a vinylchloride resin, SBR, polybutadiene resin, polyisoprene, a polyvinyl butyral resin, polyvinyl ether, an ionomer resin, SIS, SEBS, an acryl resin, an ethylene-vinyl chloride copolymer, an ethylene-acryl copolymer, an ethylene-vinyl acetate resin (EVA), a vinyl chloride grafted EVA resin, an EVA grafted vinyl chloride resin, a vinyl chloride resin, various modified olefins, polyethylene, polypropylene and polyvinyl butyral. The binder thickness of the image receiving layer is preferably 0.8 to 2.5 μm. When the image receiving layer works as a cushion layer as well, the thickness of the image receiving layer is preferably 15 to 50 μm, more preferably 30 to 50 μm.

The image receiving layer has preferably protrusions to obtain suitable close contact with the aforesaid material, for example, the image receiving layer preferably contains a matting agent. The volume average particle size of the matting agent is preferably 2 to 5 μm larger than the average thickness of the receiving layer in the absence of the matting agent, and the matting agent content in the image receiving layer is preferably 0.02 to 0.2 g/m$^2$. With not more than 2 $\mu$m, sufficient close contact under a reduced pressure is difficult to obtain, and with not more than 5 $\mu$m, conversely close contact with the receiving material deteriorates. This content of the matting agent is preferable in keeping moderate adherence in a thin layer heat fusion transfer recording method comprising a thin membrane of colorant layer and particularly in a heat mode transfer recording method.

It is preferable that the matting agent of which the number average particle size is 2 to 4 $\mu$m larger than the average thickness of the image receiving layer in the absence of the matting agent is contained in the image receiving layer in an amount of 70% or more. Besides, the image receiving layer contains a fluorine type compound, a silicone type compound and wax derivative as an additive. These compounds can be effective means against occurrence of pressure fog and sensitivity fluctuation when circumstance in recording an image flucutuates. The above-mentioned compounds are preferably silid in point of storage.

In the intermediate transfer material of the present invention, a releasing layer may be provided between the image receiving layer and the cushion layer. The releasing layer is especially effective in re-transferring an image of the image receiving layer, to which the image is transferred from the intermediate transfer material, onto a final image receiving sheet.

The binder of the releasing layer includes polyester, polyvinyl acetal, polyvinyl formal, polyparabanic acid, polymethylmethacrylate, polycarbonate, ethylcellulose, nitrocellulose, methylcellulose, carboxymethylcellulose, hydroxypropylcellulose, polyvinyl alcohol, polyvinyl chloride, polystyrene, styrenes such as polyacrylo nitrile styrene or their cross-linked polymers, a heat hardenable resin having a Tg of 65° C. or more such as polyamide, polyimide, polyetherimide, polysulfone, polyethersulfone or aramide or their hardened resin. The cross-linking agent includes a conventional one such as isocyanate or melamine.

The binder of the releasing layer is preferably polycarbonate, acetal, or ethylcellulose in view of storage stability, and it is more preferable that when an acryl resin is used in the image receiving layer, releasing is excellent in re-transferring an image transferred after a laser heat transfer method.

Further, a layer whose adhesiveness to the image receiving layer is poor in cooling can be used as a releasing layer. Such a layer is, for example, a layer containing a heat fusible compound such as waxes or a thermoplasticizer.

The heat fusible compound includes compounds disclosed in JP-A No. 63-193886, and microcrystalline wax, paraffin wax or carnauva wax is preferably used. As the thermoplasticizer, an ethylene copolymer such as ethylene-vinyl acetate copolymer or a cellulose resin is preferably used.

As an additive, a higher fatty acid, a higher alcohol, a higher fatty acid ester, an amide or a higher amine is optionally added to the releasing layer.

Another releasing layer is a layer which is melted or softened while heating, resulting in cohesive failure and is released. Such a layer preferably contains a supercooling agent. The supercooling agent includes polycaprolactam, polyoxyethylene, benzotriazole, tribenzylamine and vanillin.

Still another releasing layer may contain a compound lowering adhesiveness to the image receiving layer. The compound includes a silicone resin such as silicone oil, a fluorine-containing resin such as teflon or a fluorine-containing acryl resin or a polysiloxane resin, an acetal resin such as polyvinyl butyral, polyvinyl acetal, polyvinyl formal, solid wax such as polyethylene wax or amide wax, a fluorine-containing surfactant and a phosphate surfactant.

The releasing layer is formed by dissolving or dispersing the compounds described above in a solvent and coating the resulting solution or dispersion on the cushion layer by means of a blade coater, a roller coater, a bar coater, a curtain coater or a gravure coater, or by hot-melt extrusion laminating. Further, the releasing layer can be formed by coating the resulting solution or dispersion on a temporary support, laminating the coated layer on the cushion layer, and then peeling the temporary support.

The thickness of the releasing layer is preferably 0.3 to 3.0 $\mu$m. When the releasing layer is too thick, property of the cushion layer is difficult to develop, and the thickness need be adjusted according to kinds of the releasing layer.

<Thermal Transfer Image Forming Material>

The intermediate transfer material of the invention can be used for thermal transfer, preferably used as an intermediate transfer material of a recording material for heat fusible transfer employing a conventional thermal head, electric head or laser. The intermediate transfer material can be also apllied to the ablation type thermal transfer and the sublimation type thermal transfer. It is especially effective when the intermediate transfer material is employed for a thin layer thermal transfer material in which an extremely thin colorant layer whose layer thickness is 1.5 $\mu$m or less is transferred by heat. The intermediate transfer material of the invention can obtain excellent peeling static charge resistance and transportation ability and improve electrostatic adsorption and transportation trouble.

The thin layer heat transfer recording material can be provided on a support usable for a conventional thermal transfer recording. The support of which the rear surface is subjected to releasing treatment is preferably a smooth plastic film having a thickness of 5 to 300 $\mu$m, preferably 5 to 25 $\mu$m. For example, PET, PEN, PP and polyimide, etc. can be used.

Other recording material used in combination with the intermediate transfer material of the invention is preferably a heat mode type thermal transfer recording material having a light-heat converting function. Specifically, the heat mode type thermal transfer recording material in which the ink layer is transferred by melting or ablation is preferable, but the heat mode type thermal transfer recording material in which a dye is transferred by sublimation can be also used.

In cases where the ink layer is transferred by melting or ablation, the heat mode type thermal transfer recording material has at least a colorant layer having a light-heat converting function on a support, a light-heat converting layer and a colorant layer in this order on the support, and optionally has a cushion layer or a releasing layer between the above layer and the support. Further, a back coat layer may be provided on a back side of the support opposite to the colorant layer. In cases where a dye is transferred by sublimation, it is preferable to provide a colorant layer having a light-heat converting function on a support, if necessary, a cushion layer, a releasing layer or a back coat layer can be used.

The support of the recording material is the same as denoted in the intermediate transfer material. When an image is formed by exposing to a laser light from the recording material side, the support of the recording material is preferably transparent. When an image is formed by exposing to a laser light from the intermediate transfer material side, the support of the recording material need not be transparent. The thickness of the heat mode recording material is preferably thinner than that of the intermediate transfer material in view of easiness of superposing.

The colorant layer is a layer which contains a colorant and a binder and is melted or softened while heating to be transferred to another sheet, although the layer need not be completely melted to transfer.

The colorant includes inorganic pigment (for example, titanium dioxide, carbon black, graphite, zinc oxide, prussian blue, cadmium sulfate, iron oxide, lead oxide, zinc oxide, and chromate of barium and calcium), organic pigment (for example, azo compounds, indigo compounds, anthraquinone compounds, anthanthrone compounds, triphenedioxazine compounds, vat dye pigment, phthalocyanine pigment or its derivative, and quinacridone pigment) and dyes (for example, acidic dyes, direct dyes, dispersion dyes, oil soluble dyes, metal-containing oil soluble dyes and sublimable dyes).

For example, as pigment for a color proof, C.I. 21095 or C.I. 21090 is used as a yellow pigment, C.I. 15850:1 as a magenta pigment, and C.I. 74160 as a cyan pigment. In the case of using blue, yellow and red, Lyonol blue FG-7330, Lyonol yellow No. 1406G, Lyonol red 6BFG-4219X (all of them are produced by Toyo Ink Co.) can be employed.

The colorant content in the colorant layer may be adjusted in such a manner that an intended content can be obtained based on the intended coating thickness, and not specifically limited. The colorant content of the colorant layer is ordinarily 5 to 70% by weight, and preferably 10 to 60% by weight.

The binder of the colorant layer includes a heat fusible compound, a heat softening compound, and a thermoplastic resin. The heat fusible compound is a solid or semi-solid compound having a melting point of 40 to 150° C., the melting point measured by means of a melting point apparatus, Yanagimoto JP-2, and includes waxes, for example, vegetable wax such as carnauba wax, Japan wax, or esparto wax, animal wax such as bees wax, insect wax, shellac wax or spemaceti, petroleum wax such as paraffin wax, microcrystalline wax, polyethylene wax, ester wax or acid wax, and mineral wax such as montan wax, ozocerite or ceresine. The binder further includes a higher fatty acid such as palmitic acid, stearic acid, margaric acid or behenic acid, a higher alcohol such as palmityl alcohol, stearyl alcohol, behenyl alcohol, margaryl alcohol, myricyl alcohol or eicosanol, a higher fatty acid ester such as cetyl palmitate, myricyl palmitate, cetyl stearate or myricyl stearate, an amide such as acetoamide, propionic amide, palmitic amide, stearic amide or amide wax, and a higher amine such as stearyl amine, behenyl amine or palmityl amine.

The thermo plasticizer includes resins such as an ethylene copolymer, a polyamide resin, a polyester resin, a polyurethane resin, a polyoleffin resin, an acryl resin, a polyvinyl chloride resin, a cellulose resin, a rosin resin, a polyvinyl alcohol resin, a polyvinyl acetal resin, an ionomer resin or a petroleum resin; elastomers such as natural rubber, styrene-butadiene rubber, isoprene rubber, chloroprene rubber or a diene copolymer; rosin derivatives such as an ester rubber, a rosin-maleic acid resin, a rosin phenol resin or a hydrogenated rosin; a phenol resin, terpenes, a cyclopentadiene resin or aromatic hydrocarbon resins. The resin whose melting point or softening point is 70 to 150° C. is preferably used. Further, a polystyrene resin, a styrene-acryl resin and a polyvinylbutyral resin can be used.

The thermal transfer layer having an intended softening or melting point can be obtained by suitably using the above described heat fusible compound or thermo plasticizer.

As disclosed in JP-A No. 62-108092, uniforming the particle size of pigments can give high image density, but various additives can be used in order to secure pigment dispersion property or to obtain excellent color reproduction.

The additives include a plasticizer for increasing sensitivity by plasticizing the colorant layer, a surfactant for improving coatability, and a matting agent having a submicron to millimicron order particle size for minimizing blocking. Besides, the colorant layer contains a fluorine type compound, a silicone type compound and wax derivative as an additive used similarly in the image receiving layer. These compounds can be effective means against occurrence of pressure fog and sensitivity fluctuation when circumstance in recording an image flucutuates. The above-mentioned compounds are preferably solid in point of storage. By incorporating these additives in the colorant layer of the image recording material, adhesiveness of the light-heat converting layer is lowered, and an ablation in which the light-heat converting layer is transferred together with the colorant layer is restrained when an excessive exposure is given. By adding a nonionic surfactant such as polyethyleneglycohol, etc. in an amount of not less than 2 wt % of total weight of the colorant layer, preferably not less than 5 wt %, enhancement of sensitivity and fine line reproducibility can be attained.

The coating thickness of the colorant layer is preferably 0.2 to 2 $\mu$m, and more preferably 0.3 to 1.5 $\mu$m. The thickness of not more than 0.8 $\mu$m gives high sensitivity, but the optimum thickness is selected according to balance between sensitivity and resolution or an intended image reproduction, since the transferability of the colorant layer is different from kinds of the binders used or their combination use ratio.

When the light-heat converting agent is added to the colorant layer, a light-heat converting layer is not necessary. When the light-heat converting agent is not transparent, the light-heat converting layer is preferably provided separately from the colorant layer in view of color reproduction of a transferred image. The light-heat converting layer can be provided closest to the colorant layer.

(Light-heat Converting Layer)

A light-heat converting layer formed on a support used in the invention contains a light-heat converting agent in an amount of 5 to 60 wt %, preferably 10 to 40 wt %, more preferably 15 to 30 wt % and a fluorine-containing surfactant in an amount 0.01 to 10 wt %.

As the light-heat converting agent in the light-heat converting layer, known one can be used. In preferable embodiment of the invention, the light-heat converting agent is preferably heated by a semi-conductor laser light irradiation, therefore, the light-heat converting agent has an absorption maximum in the wavelength region of 700 to 3000 nm when forming a color image. It is preferred that the light-heat converting agent is an infrared ray absorbing dye which has no or very small absorption in visible region and its absorbance to a light source of which wavelength is in near infrared region of 700 to 1000 nm is at least 0.25, preferably 0.5. In the present invention, the light-heat converting agent in the light-heat converting layer is most preferably the infrared ray absorbing dye of which absorbance at the wavelength of 830 nm is 0.5 to 1.5.

The light-heat converting compound is preferably a compound which absorbs light and effectively converts to heat, although different due to a light source used. For example, when a semi-conductor laser is used as a light source, a compound having absorption in the near-infrared light region is used. The near-infrared light absorbent includes an inorganic compound such as carbon black, an organic compound such as cyanine, polymethine, azulenium, squalenium, thiopyrylium, naphthoquinone or anthraquinone dye, and an organic metal complex of phthalocyanine, azo or thioamide type. Exemplarily, the near-infrared light absorbent includes compounds disclosed in JP-A Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds can be used singly or in combination of two or more kinds thereof. Further, when dispersing the near-infrared light absobent such as the carbon black, etc. to effectively absorb near-infrared light, an adding amount of surfactant is preferably decreased or no surfactant is added. In order to decrease the adding amount of the surfactant to the utmost, the surface of the near-infrared light absorbent is preferably modified so as to be more dispersible. Concretely, the surface of the carbon black is modified with a carboxylic acid group or a sulfonic acid group.

As the binder of the light-heat converting layer are used resins having high Tg and high heat conductivity. The binder includes resins such as polymethylmethacrylate, polycarbonate, polystyrene, ethylcellulose, nitrocellulose, polyvinylalcohol, polyvinyl chloride, polyamide, polyimide, polyetherimide, polysulfone, polyethersulfone, gelatin, polyvinylpyrrolidone, polyester, polyamide acid, polyparabanic acid, aramide and colloidal silica.

A water soluble polymer can be also used in the light-heat converting layer. The water soluble polymer is preferable because it gives excellent peelability between the colorant layer and the light-heat converting layer, has high heat resistance while irradiating light, restrains scatter or ablation of the light-heat converting layer when excessive heat is applied. When the water soluble polymer is used, it is preferable that the light-heat converting compound is water soluble (by incorporation of a sulfonic acid group to the compound) or dispersed in water. The addition of a releasing agent to the light-heat converting layer can give excellent peelability between the colorant layer and the light-heat converting layer and can improve sensitivity. The releasing agent includes a silicone releasing agent (for example, a polyoxyalkylene modified silicone oil or an alcohol modified silicone oil), a fluorine-containing surfactant (for example, a perfluoro phosphate surfactant), and other various surfactants.

The thickness of the light-heat converting layer is preferably 0.1 to 3 $\mu$m, and more preferably 0.2 to 1 $\mu$m. The light-heat converting agent content of the light-heat converting layer can ordinarily be determined in such a manner that the layer gives an optical density of preferably 0.3 to 3.0, more preferably 0.7 to 2.5 to light wavelength emitted from a light source used. When carbon black is used in the light-heat converting layer and the light-heat converting layer thickness is more than 1 $\mu$m, scorching due to excessive heating does not occur but sensitivity tends to be lowered. However, the thickness of the light-heat converting layer is optionally selected due to power of a laser used or the absorbance of the light-heat converting layer. Further, hydrophilic compound and nonionic compound such as glycerine and ethyleneglycol, etc. can be used in order to enhance sensitivity. By adding these compounds, peeling ability of the light-heat converting layer from the colorant layer which is made to be hydrophobic can be enhanced and sensitivity fluctuation in circumstance when recording an image can be restrained.

When the light-heat converting layer is poor in adhesiveness to a support, color mixture due to layer separation is likely to occur in peeling the recording material from the intermediate transfer material at the time of light irradiation or after heat transfer, therefore, an adhesive layer may be provided between the support and the light-heat converting layer.

A conventional adhesive such as polyester, urethane or gelatin may be used in the adhesive layer. Further, in order to obtain the above effect, a cushion layer containing a tackifying agent or an adhesive may be provided instead of the adhesive layer.

As the light-heat converting layer, an evaporation layer may be used. The evaporation layer includes an evaporation layer of carbon black or metal black such as gold, silver, aluminum, chrome, nickel, antimony, tellurium, bismuth, or selenium described in JP-A No. 52-20842. The light-heat converting compound may be a colorant itself in the colorant layer and as the light-heat converting compound, various other compounds may be used without being limited to the above described compounds. In the present invention, when forming said light-heat converting layer, it is preferable that surface tension of a non-polar component of the coating solution of the light-heat converting layer is not more than 28 dyn/cm, or surface tension of a polar component of the coating solution of the light-heat converting layer is not more than 3 dyn/cm. When the surface tension of the non-polar component or the surface tension of the polar component is within these range, the coatability of the coating solution of the light-heat converting layer is remakably improved, and the surface tension of the polar component of the coating solution is more preferably not more than 0.5 dyn/cm.

In the present invention, when forming said light-heat converting layer, it is preferable that contact angle (measured 60 seconds later after coating) of the coating solution of the light-heat converting layer to an under layer of the light-heat converting layer is not more than 55°. Hereon, the under layer is a basic layer on which is formed the light-heat converting layer when coating the light-heat converting layer.

If the contact angle is not more than 55°, the coatability of the coating solution of the light-heat converting layer is remakably improved, and the contact angle is more preferably not more than 50°.

Furthermore, in the present invention, it is preferable that viscosity of the coating solution of said light-heat converting layer at shear rate of $10^{-5}$ (1/s) of the coating solution of said light-heat converting layer is not less than 400 cp. If the viscosity at the shear rate of $10^{-5}$ (1/s) is not less than 400 cp, the coating solution of the light-heat converting layer can be easily coated.

Surfactant used in the present invention includes an amphoteric surfactant, an anionic surfactant, a cationic surfactant, a nonionic surfactant and a fluorine-containing surfactant, etc. Of these, the fluorine-containing surfactant is most preferable because the coatability is improved without lowering sensitivity and so on.

The amphoteric surfactant includes lauryl dimethylamineoxide, lauryl carboxymethylhydroxyethyl, imidazolium betaine, etc. The anionic surfactant includes fatty acid salt, alkylsulfuric acid ester salt, alkylbenzenesulfonic acid salt, alkylnaphthalenesulfonic acid salt, alkylsulfosuccinic acid salt, alkyldiphenyletherdisulfonic acid salt, alkylphosphoric acid salt, polyoxyethylenealkylsulfuric acid ester salt, polyoxyethylenealkylarylsulfuric acid ester salt, condenced compound of naphthalenesulfonic acid and formalin, polyoxyethylenealkylphosphoric acid ester, etc. The cationic surfactant includes alkylamine salt, quaternary ammonium salt, alkyl betaine, etc.

The nonionic surfactant includes polyoxyethylenealkylether, polyoxyethylenealkylarylether, polyoxyethylene derivative, oxyethylene oxypropylene block-copolymer, sorbitan fatty acid ester, polyoxyethylene-sorbitol fatty acid ester, polyoxyethylenesorbitan fatty acid ester, glycerin fatty acid ester, polyoxyethylene fatty acid ester, polyoxyethylenealkylamine, alkylalkanolamide, etc.

The fluorine-containing surfactant includes acrylate containing fluoroaliphatic group, copolymer derived from methacrylate and (polyoxyalkylene)acrylate or (polyoxyalkylene)methacrylate, and compounds described in JP-A Nos. 62-170950, 62-26143, U.S. Pat. No. 3,787,351. Exemplarily, are cited Megafack F-171, 173, 177, Diffensa MCF 300, 312, 313 (produced by Dainihon Ink Chemical Co.), Modipar F-100, 102, 110 (produced by Nihon Yushi Co.), etc. The content ratio of the fluorine-containing surfactant in the composition of the light-heat converting layer is 0.01 to 10 wt %, preferably 0.01 to 3 wt %, more preferably not more than 1 wt %.

In the present invention, the fluorine-containing surfactant preferably contains nonionic type perfluorocarbon group.

Exemplified compounds of the fluorine-containing surfactant are shown below, but are not limited thereto.

$C_8F_{17}SO_3K$ F-1

$C_8F_{17}SO_3N(C_2H_5)_4$ F-2

$C_7F_{15}COONa$ F-3

$C_8F_{17}CH_2CH_2OSO_3Na$ F-4

F-5

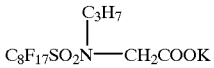

F-6

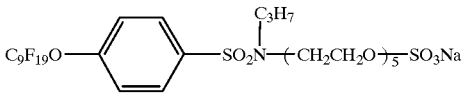

F-7

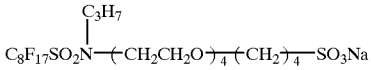

F-8

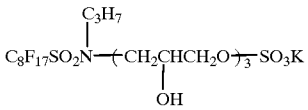

F-9

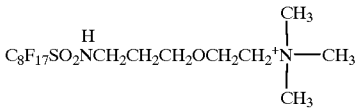

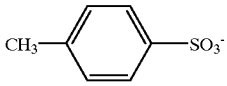

F-10

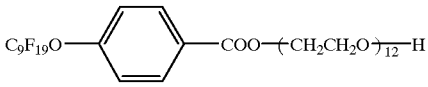

F-11

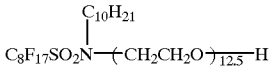

-continued

F-12

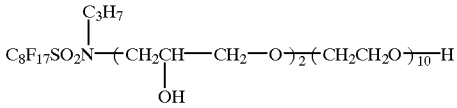

F-13

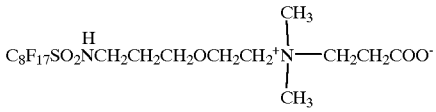

F-14

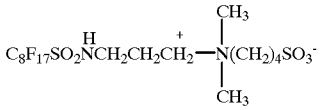

F-15

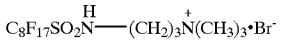

F-16

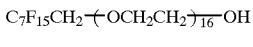

F-17

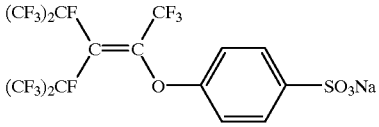

F-18

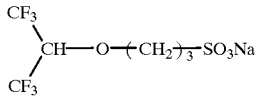

F-19

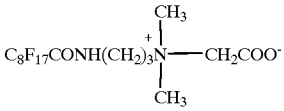

F-20

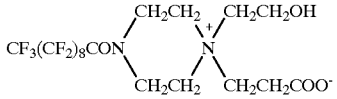

Further, in the present invention, absorbance per unit area amount at wavelength of laser beam light in the light-heat converting layer is established by color, and the absorptions are combined so as to be substantially different with every color, thereby it becomes easy to establish proper exposing condition and occurrence of ablation, decrease of sensitivity and color contamination of images in exposing operation can be restrained. "Combined so as to be substantially different" means that absorption of the light-heat converting layer corresponding to at least one color of plural colors is different by not less than 0.1%, preferably by not less than 1% in terms of relative absorption strength.

The ratio of the light-heat converting agent and the binder is 7:3 to 1:9, preferably 5:5 to 2:8. The membrane thickness of the light-heat converting layer is preferably 0.1 to 1 $\mu$m, and the content of the light-heat converting agent in the light-heat converting layer is usually determined so that the absorance at wavelength of the light source used in image recording is 0.3 to 3.0. By varying the content of the light-heat converting agent, the absorbance of the laser beam light per unit coated amount is varied so that the absorbance of the laser beam light per unit area is able to be varied. Further, by varying the thickness of the light-heat converting layer, the absorbance of the laser beam light per unit area is able to be varied.

As the binder used in the light-heat converting layer, known one can be used, but preferred one is a resin which shows temprature, where weight decreasing ratio of said resin measured by thermal decomposition measurement using TGA method under the condition of nitrogen atmosphere and temperature increasing rate of 10° C./min. is to be 50%, is not less than 360° C. Concretely, cited is a bridged compound or a hardened compound such as various functional plastics, a water soluble binder and a thermally plasticized resin, etc.

Of these, preferable one is the water soluble binder, for example, are cited polyvinylalcohol (PVA), polyvinylacetal, polyvinylbutyral, polyvinylpyrrolidone, nylon, polyacrylamide, polyalkyleneoxide, gelatin, casein, methylcellulose, hydroxyethylcellulose, carboxymethylcellulose, hydroxyethyl starch, gum arabi, sucrose octaacetate, ammonium alginate, sodium alginate, polyvinylamine, polyethyleneoxide and polyacrylic acid, etc. Of these, are preferably cited polyvinylalcohol, polyvinylacetal, nylon, polyacrylamide and polyalkyleneoxide. On the other hand, as the functional plastics, preferable ones are polyalkydimide, polyallylate, polyimide, polyamide acid, polyetherimide, polyetheretherketone, polycarbonate, polysulfone, polyethersulfone, polramidesulfone, polyphenyleneether and polyphenylenesulfide, etc.

Furthermore, are cited single polymer or copolymer of acryl type monomers obtained from acrylic acid, cellulose type polymer such as cellulose acetate, polystyrene, vinyl chloride/vinylacetate copolymer, condensed type polymers such as polyester and polyamide, rubber type thermally plasticized polymer such as butadiene/styrene copolymer, polyurethane, polyimide, epoxy resin and urea/melamine resin, etc.

The absorbance/$\mu$m at exposure wavelength differs depending on exposure illumination intensity, but it is preferably not more than 3.0, more preferably not more than 1.5.

Furthermore, when the ink layer contains the color corresponding to the wavelength of the laser beam light, for example, when it contains black color, it is preferable to establish the density of black color per unit coating weight to be higher than that of other colors. The ink layer containing black color itself absorbs laser beam light and at an excessive exposure the ink layer is transferred so as to be overheated than suitable temperature leading to decrease of a transferred density. Accordingly, in the case of the black color ink, preferable absorbance per unit coating weight of the light-heat converting layer is not less than 0.6, more preferably 0.7. Thus, the ink layer can obtain lighttightness by the light-heat converting layer so as to obtain an image having uniform density.

To avoid a dilemma between the sensitivity and the heat resistance, for example, it is preferred to provide separately another light-heat converting layer as a layer of incidence of recording light of which absorbance per unit membrane thickness is less. That is, by providing the light-heat converting layer as the layer of light incidence of which absorbance/$\mu$m is not more than 1.5, and further by providing the second light-heat converting layer of which absorbance/$\mu$m is not less than 1.5 between the above-mentioned layer of light incidence and the ink layer, it is possible to produce the recording material with higher sensitivity and higher heat resistance. Depending on the absorbance per unit membrane thickness of the light-heat converting layer and the degree of close contact of the light-heat converting layer with an adjacent layer or the receiving material, as is described in Journal of maging Science and Technology, on page 180, 36 (2) (1992), temperature reaches not less than 600° C. In the case of a heat mode laser recording, the reaching temperature of the light-heat converting layer is remarkably high and temperature change is extremely short. Therefore, it is unsuitable to select a binder in terms of heat resistance. That is, it is suitable to consider close contact under a reduced pressure and in spite of the high reaching temperature, temperature-raising/temperature-lowering being done in extremely short time in selecting the binder. With respect to the heat resistance of the binder, various measuring methods and the recorded characteristics corresponding to the aforesaid measuring methods were examined. As a result, employing dynamic thermal decomposition measurement by TGA method (thermal weight analysis), to measure temperature (hereinafter referred to as TGA50 thermal decomposition temperature) where weight decreasing ratio under the thermal decomposition condition of nitrogen atmosphere and temperature raising rate of 10° C./min. is to be 50% is suitable to evaluate the heat resistance.

In the light-heat converting layer, can be added a surfactant to improve coatability and a releasing agent to accelerate interface peeling between the light-heat converting layer and the ink layer. Specifically, as the releasing agent, it is preferable to add a silicone compound, a fluorine type compound, an olefin type compound and a long chain alkyl type compound such as a wax.

As preferable silicone compounds, are cited polydimethylsiloxane and its modified compound, for example, oils and resins such as polyester modified silicone, acryl modified silicone, urethane modified silicone, alkyd modified silicone, amino modified silicone, epoxy modified silicone, and their hardened compounds.

As preferable fluorine type compounds, are cited fluorinated olefin and perfluorophosphoric ester.

As preferable olefin type compounds, are cited dispersion such as polyethylene and polypropylene, and long chain alkyl type compound such as polyethyleneimineoctadecyl.

Of these releasing agents, ones which are poor in solubility can be used in dispersion form. It is possible to modify them by addition reaction with other polymer as well as silicone compounds. To crosslink a binder, it is possible to add various kinds of crosslinking agent.

An adding amount of these additives added in the light-heat converting layer is preferably 0.01 to 20 wt % to total amount of the light-heat converting agent and the binder.

The cushion layer is provided in order to increase adhesiveness between the recording layer and the intermediate transfer material. As the cushion layer is used a heat softening or elastic layer, which contains a compound capable of being sufficiently softened and deformed by heating, a compound with low elasticity or a compound with elastic property. The example of the compound includes the same compound as denoted in the cushion layer of the intermediate transfer material.

The cushion layer is provided by means of a coating method, a lamination method or adhesion of a film in order to obtain the appropriate thickness. The cushion layer may be provided by the coating method in order to obtain the surface smoothness.

The cushion layer is preferably provided to improve close contact under a reduced pressure in the recording material as well as the imtermediate transfer material of the present invention.

The cushion layer may be provided in the same manner as used in providing the cushion layer of the intermediate transfer material. As a special cushion layer, a resin layer having a void structure obtained by foaming a thermo-softening or thermo-plasticized resin can be used. When a cushion layer requiring a smooth surface is further provided, various coating methods are preferably carried out. The total thickness of the cushion layer is preferably 0.2 μm or more, and more preferably 1 μm or more, specifically preferably 2 μm or more. And it is preferably not more than 50 μm, more preferably not more than 20 μm, specifically preferably not more than 5 μm.

In the light-heat converting type heat mode recording, energy loss by heat conductivity from the colorant layer to the support is decreased by shortening an exposure time. In the heat mode recording, heat energy given to other layer other than the colorant layer is smaller compared with conventional thermal transfer recording in which the colorant layer is heated by heat conductivity from the support side employing a thermal head. For this reason, it is considered that the intermediate layer needs to have the sufficient cushion property by heat energy generated in the colorant layer when exposed. To lower elasticity or obtain heat softening by this slight amount of heat, Tg of a resin forming the intermediate layer is preferably not higher than 80° C.

To make the colorant layer absorb effectively light energy of the light-heat converting heat mode recording light source, transmittance to wavelength of the light source through the support and the intermediate layer is preferably 70%, more preferably 80%. For this purpose, it is necessary to use the support and the intermediate layer having good transmission and to minimize reflection on the back coat layer of the support and on the interface between the support and the intermediate layer.

In order to minimize reflection on the interface between the support and the intermediate layer, the refractive index of the intermediate layer is preferably smaller by at least 0.1 than that of the support so that the energy loss caused by the interface reflection can be largely decreased.

In a color proof field, etc., the colorant layer is contained in a recording material constitution and is imagewise exposed in response to an image information by the laser beam light and then is transferred to the receiving material through light-heat converting. And in a printing plate field, etc., the phase change of an image forming layer adjacent to the light-heat converting layer caused by ligh-heat conversion of the light-heat converting layer when exposed to the laser beam light results in forming an image.

The materials used in each of the aforesaid layers are dissolved in solvent or dispersed in latex form, then coated by coating method including blade coater method, roll coater method, bar coater method, curtain coater method, gravure coater method, extrusion lamination method employing hot melt, and a cushion layer film pasting method is also applicable, so that the recording material according to the present invention can be formed. In this case, all layers may be coated and formed in order on a single support, or some layers may be coated on a separate support and then stuck, so that the recording material can be formed by peeling. In the case of the thermal transfer recording material set of the present invention comprising the intermediate transfer material and plural thermal transfer image forming materials, color of each colorant layer of the plural thermal transfer image forming materials is preferably different. The thermal transfer recording material set comprises more preferably four thermal transfer image forming materials which consists of four colorant layers of yellow (Y), magenta (M), cyan (C) and black (K). The plural thermal transfer image forming materials may consist of plural colorant layers having only two colors, and they may consist of plural colorant layers having the same color.

[A Thermal Transfer Image Forming Material]

A method for producing a light-heat converting heat mode recording material in the present invention comprises the steps: (1) a step for sticking a support A having thereon a colorant layer and a light-heat converting layer in this order on a separately provided support B having thereon a cushion layer; (2) a step for transferring the colorant layer and the light-heat converting layer peeled off from the previously mentioned support A to the separately provided support B having thereon the cushion layer; wherein content ratio of a light-heat converting agent in said light-heat converting layer is 5 to 60 wt % and that of a fluorine-containing surfactant is 0.01 to 10 wt %. The method for producing the recording material used in the present invention is characterized in that the separately provided support having thereon a cushion layer is treated through the processes, that is, sticking transferring-peeling, and the material used for forming the support includes the above-mentioned material.

Preferable embodiments in producing the recording material include following items;

(a) Said fluorine-containing surfactant contains a nonionic perfluorocarbon group.
(b) Said light-heat converting agent is a near infrared ray absorbing dye of which absorbance at 830 nm is 0.5 to 1.5.
(c) Said near infrared ray absorbent is carbon black.
(d) Surface tension of a non-polar component of a coating solution of said light-heat converting layer is not more than 28 dyn/cm, or surface tension of a polar component of the coating solution of said light-heat converting layer is not more than 3 dyn/cm.
(e) Contact angle (measured 60 seconds later after coating) of a coating solution of said light-heat converting layer to an under layer of said light-heat converting layer is not more than 55°.
(f) Viscosity of a coating solution of said light-heat converting layer at shear rate of $10^{-5}$ (1/s) of said coating solution of said light-heat converting layer is not less than 400 cp.

The support comprising thereon the colorant layer and the light-heat converting layer in this order may be termed temporary support.

<Image Forming Method>

In the present invention, the thermal transfer recording is carried out by a laser exposure as employed in heat mode recording and by using a thermal head, etc. In the heat mode recording, a colorant layer is transferred by ablation and melting and only dye in the colorant layer is transferred by sublimation. In exposing method of the heat mode recording, while bringing the recording material in close contact with the intermediate transfer material, the exposure was carried out from the support side of the recording material or from the intermediate transfer material side.

The laser beam light source for recording the image includes a semiconductor laser, a YAG laser, a carbon acid laser and a helium-neon laser, etc. Of the semiconductor lasers, a single mode laser diode, of which $1/e^2$ diameter is easy to be condensed to a few μm to tens of μm at the focus without large lowering of optical efficiency.

As a usable light source other than the laser beam light, is cited a light emission diode (LED). As arrays integrated with plural light emission elements, LED and the semiconductor laser are easy to use.

In the present invention, it is preferable to recording an image first with the laser-melt thermal transfer recording material comprising color corresponding to said light-heat converting layer of which absorbance per unit coating weight is established to be the largest. In the laser-melt thermal transfer recording, to carry out the laser exposure imagewise by bringing the thermal transfer recording material in close contact with the receiving material (for example, close contact under a reduced pressure), a receiving surface of the receiving material is roughened, but when plural ink layers are transferred, the roughness of the receiving surface becomeds smaller, as a result, the close contact effect under the reduced pressure becomes lowered, leading to occurrence of transfer unevenness. On the other hand, when the absorbance per unit coating weight of the light-heat converting layer is too large, generated amount of gas at the laser exposing time (gas generates with or without the existence of ablation) is increased. In a system in which an image comprising plural colors by superposing plural colors by repeatedly recording monochromatically colored image is formed, in cases where the recording material in which the absorbance per unit coating weight of the light-heat converting layer is the largest is used last in exposing process, close contact rate under the reduced pressure can not catch up with the generated amount of gas, as a result, the close contact of the recording material with the receiving material is interfered, resulting in color contamination or lowering of color reproductin. Accordingly, to restrain the transfer unevenness by gas generation, it is preferable to record the image first with the recording material comprising color corresponding to the light-heat converting layer of which absorbance per unit coating weight unit is established to be the largest and in which the generated amount of gas tends to increase.

As scanning methods of laser, are cited a cylindrical exterior scanning method, a cylindrical interior scanning method and a plane scanning method. In the cylindrical exterior scanning method, a laser exposure is carried out by rotating a drum around the exterior of which is wound with the thermal transfer image forming material, making the rotation of the drum to be a main scanning and the movement of the laser beam light to be a sub scanning. In the cylindrical interior scanning method, the thermal transfer image forming material is fixed in the iterior of a drum and the laser beam light is emitted from the interior, and the main scanning is carried out in the direction of circumference by rotating a part or all of an optical system and the sub scanning is carried out in the direction of axis by moving a part or all of an optical system in a straight line parallel to an axis of the drum. In the plane scanning method, the main scanning of the laser beam light is carried out in combination of a polygonal mirror or a galvano mirror with a fθ lens and the sub scanning is carried out by moving the thermal transfer image forming material. The cylindrical exterior scanning method and the cylindrical interior scanning method are easy to enhance accuracy of the optical system and suitable in high density recording.

In the case of a multi channel exposure using simultaneously plural emmiting elements, the cylindrical exterior scanning method is the most suitable. In cases where YAG laser, etc. having large exposure output are employed, as it is difficult to obtain large increase of drum rotational rate with the cylindrical exterior scanning method, the cylindrical interior scanning method is suitable.

When exposure is carried out from the support side of the thermal transfer image forming material, the image receiving layer and/or the cushion layer preferably contains a heat absorbing colorant so that the layers absorb any heat which the thermal transfer image forming material can not completely absorb. This is useful for effectively employing heat or improving transferability.

In the latter case, in order for the colorant layer to effectively absorb a light source emitting energy, the intermediate transfer medium has a transmittance of preferably 70% or more, and more preferably 80% or more to the light from the light source. For the purpose of the above, a transparent support or a transparent cushion layer is used, and at the same time, reflection of the back coat surface of the support or the interface between the support and the cushion layer needs to be minimized. In order to minimize reflection of the interface between the support and the cushion layer, the refractive index of the cushion layer is preferably at least 0.1 smaller than that of the support.

The intermediate transfer material of the present invention works most effectively in the heat mode laser recording. In the heat mode laser recording, an image is recorded by the laser exposure or heat employing the close contact means under a reduced pressure in which the intermediate transfer material is brought in close contact with the thermal transfer image forming material under a reduced pressure, thereafter the intermediate transfer material is peeled off from the thermal transfer image forming material, then the intermediate transfer material to which an image is transferred is superposed onto a final recording material. By heat-laminating thus obtained intermediate transfer material and the final recording material and transferring the image together with the receiving layer to the final recording material and peeling off the intermediate transfer material from the final recording material, the image is finally transferred to the final recording material. In cases where the surface of the receiving layer of the intermediate transfer material to which an image is already transferred is in contact with at least one of an insulated transportation guide, an insulated transportation roll, an extremely high electroconductive transportation guide and an extremely high electroconductive transportation roll, an effectiveness of the present invention is remarkable

EXAMPLES

The invention is described below referring examples, embodiments of the invention are not limited thereto.

Example 1

<Preparing an Intermediate Transfer Material>

On a 100 μm thick PET (polyethylene terephthalate: T-100, produced by Diafoil Hoechst Co.) was coated acryl type latex (Yodosol AD92K, made by Kanebo NSC Co.) by an applicator so as to obtain a cushion layer having a dry thickness of 30 μm.

The following coating solution composition of a releasing layer was coated on the above obtained cushion layer employing a wire bar coating and dried so as to obtain the releasing layer having a dry coating weight of about 1.7 g/m$^2$.

| (Coating solution of a releasing layer) | |
|---|---|
| Ethylcellulose (Etcell 10, made by Dow Chemical) | 10 parts |
| i-Propylalcohol | 90 parts |

Next, the following composition of a coating solution of a receiving layer was coated on the releasing layer employing the wire bar coating so as to obtain the receiving layer having the dry coating weight of about 1.3 g/m$^2$. Thus a receiving material is produced.

| (Coating solution of a receiving layer) | |
|---|---|
| Polyacrylic acid latex (Yodosol A5805, made by Kanebo NSC Co.) | 25 parts |
| 30 wt % water dispersion of matting material (MX-40S*, made by Soken Kagaku Co.) | 1.8 parts |
| Fluorine-containing resin (Sumirese resin FP-150, made by Sumitomo Kagaku Co.) | 4.2 parts |
| i-Propylalcohol | 9 parts |
| Water | 60 parts |

(*PMMA particles having an average particle size of 4.1 μm by observing with a scanning electron microscope (SEM))

<Preparing a Back Coat Layer>

On the back of the intermediate transfer material obtained above was coated each back coat layer having each following composition respectively so as to obtain the intermediate transfer medium A to D.

| Back coat layer A (comparative example) | |
|---|---|
| 18 wt % of methyl ethyl ketone (MEK) dispersion of MHI black #273 (carbon black, made by Mikuni Shikiso Co.) | 2.33 parts |
| 10 wt % of MEK dispersion of MX-1000 (acryl matting material having an average particle size of 10 μm, made by Soken Kagaku Co.) | 2.10 parts |
| 5 wt % of MEK solution of X24-8300 (dissolved component of silicone resin, made by Shinetsu Kagaku Co.) | 1.40 parts |
| 30 wt % of MEK solution of Vyron 200 (polyester resin, made by Toyobo Co.) | 21.00 parts |
| MEK | 5.37 parts |
| Toluene | 12.60 parts |
| Anone | 25.20 parts |

After coated, obtained intermediate transfer material was dried at 100° C. in a thermostat for 1 minute. Dry coating weight is about 2.3 g/m$^2$.

| Back coat layer B (inventive example) | |
|---|---|
| 18 wt % of methyl ethyl ketone (MEK) dispersion of MHI black #273 (carbon black, made by Mikuni Shikiso Co.) | 3.11 parts |
| 10 wt % of MEK dispersion of MX-1000 (acryl matting material having an average particle size of 10 μm, made by Soken Kagaku Co.) | 2.10 parts |
| 5 wt % of MEK solution of X24-8300 (dissolved component of silicone resin, made by Shinetsu Kagaku Co.) | 1.40 parts |
| 30 wt % of MEK solution of Vyron 200 (polyester resin, made by Toyobo Co.) | 20.53 parts |
| MEK | 5.06 parts |
| Toluene | 12.60 parts |
| Anone | 25.20 parts |

After coated, obtained intermediate transfer material was dried at 100°C. in the thermostat for 1 minute. The dry coating weight is about 2.3 g/m$^2$.

| Back coat layer C (comparative example) | |
|---|---|
| 18 wt % of methyl ethyl ketone (MEK) dispersion of MHI black #273 (carbon black, made by Mikuni Shikiso Co.) | 4.86 parts |
| 10 wt % of MEK dispersion of MX-1000 (acryl matting material having an average particle size of 10 μm, made by Soken Kagaku Co.) | 2.10 parts |
| 5 wt % of MEK solution of X24-8300 (dissolved component of silicone resin, made by Shinetsu Kagaku Co.) | 1.40 parts |
| 30 wt % of MEK solution of Vyron 200 (polyester resin, made by Toyobo Co.) | 19.48 parts |
| MEK | 4.36 parts |
| Toluene | 12.60 parts |
| Anone | 25.20 parts |

After coated, obtained intermediate transfer material was dried at 100° C. in the thermostat for 1 minute. The dry coating weight is about 2.3 g/m$^2$.

| Back coat layer D (comparative example) | |
|---|---|
| 10 wt % aqueous solution of polyvinyl alcohol (Gosenol EG-30, made by Nihon Gosei Kagaku Co.) | 8.1 parts |
| Melamine resin (Sumirese resin 613, made by Sumitomo Kagaku Co.) | 0.8 parts |
| Amine salt (Sumirese resin ACX-P, made by Sumitomo Kagaku Co.) | 0.1 parts |
| Fluorine-containing resin (Sumirese resin FP-150, described previously) | 0.5 parts |
| 10 wt % dispersion of matting material (Sailisia 470*, made by Fuji Silisia Kagaku Co.) | 0.5 parts |

(*; Sailisia 470 is synthesized silica particle having an average particle of 12 μm, $\sigma/r_n$ = 0.65, measured by call counter method)

After coated, obtained intermediate transfer material was dried at 100° C. in the thermostat for 1 minute. The dry coating weight is about 2.3 g/m$^2$.

With respect to these intermediate transfer materials, the heat mode transfer was carried out as follows. The image recording was carried out using Konica color decision transfer film and output was performed by Konica color decision EV-laser-proofer TCP-1080C, thereafter lamination transfer to a paper which is a final support was performed by employing EV-laser-laminater TP80. The intermediate transfer material to which an image was transferred was evaluated according to the following criteria.

50% Surface Specific Resistance

After the intermediate transfer material was subjected to moisture adjustment at temperature of 23° C., humidity of 50% for 3 hours, the back coat layer surface was measured.

Surface Specific Resistance Just After Lamination

Since the intermediate transfer material was heated over 100° C. just after lamination, water contained in the intermediate transfer material was evaporated and the surface specific resistance was increased. Accordingly, the back coat layer surface was measured within 30 seconds after lamination. That is, the surface specific resistance was measured under very low humidity condition (not higher than 50%).

Peeling Static Charge

The intermediate transfer material discharged from the laminater was peeled off after discharged, and an amount of peeling static charge of the receiving layer just after peeling was measured.

Transportation Property

In order to evaluate a transportation failure caused by electrostatic adsorption of the intermediate transfer material with a insulating material, teflon seal was stuck on a flat plane board and slippage property of the intermediate transfer material was evaluated by rubbing the above-mentioned board against the intermediate transfer material (condition was 23° C. and 50% humidity).

A; No transportation failure occurred.

B; Transportation failure occurred and adsorption with the teflon seal occurred.

Obtained results are shown in Table 1.

TABLE 1

| Intermediate transfer material | Content of solid composition (%) | 50% surface specific resistance (log) | Surface specific resistance just after lamination (log) | Transportation property | Peeling static charge /kV | Remarks |
|---|---|---|---|---|---|---|
| A | 6 | 12.5 | 12.9 | A | −4 | Comp. |
| B | 8 | 11.0 | 10.9 | A | 0 | Inv. |
| C | 12.5 | <7.0 | 7.1 | B | 0 | Comp. |
| D | — | 9.0 | 17.7 | A | −45 | Comp. |

Inv.: Invention, Comp.: Comparison

As can be seen from Table 1, with the intermediate transfer material B according to the present invention, the adsorption with the teflon seal does not occur under the ordinary condition, and no static charge when peeling (peeling static charge) is observed. However, with the intermediate transfer materials A, C and D according to the comparative examples, both the adsorption with the teflon seal and the peeling static charge are not favorably improved. Therefore, the intermediate transfer materials A, C and D are not suitable for a practical use. Furthermore, using the material mentioned later in example 2 as the thermal transfer image forming material, and using B mentioned above as the intermediate transfer material, a similar experiment was carried out and obtained result showed no peeling static charge and good transportation property.

Example 2

(Preparing a Heat Mode Recording Material)

On a 38 μm thick transparent PET (polyethylene terephthalate: T-100, produced by Diafoil Hoechst Co.) as a temporary support, were coated a colorant layer and a light-heat converting layer in this order, on the other hand, on a 100 μm thick transparent PET (polyethylene terephthalate: T-100, produced by Diafoil Hoechst Co.) as a support, was coated styrenebutadiene (Kraton G1657, produced by Shell Japan Co.) as a cushion layer having a thickness of 7 μm, thereafter the support was stuck with the temporary support. Then, the temporary support was peeled off so that the colorant layer and the light-heat converting layer were transferred to the support side so as to produce a heat mode recording material of magenta.

(Colorant Layer)

The following composition of a coating solution was coated on the temporary support employing the wire bar and dried. The dry membrane thickness was 0.5 μm

| A coating solution of the colorant layer | |
|---|---|
| Styreneacryl (Haymer SBM-73F, made by Sanyo Kasei Co.) | 2.71 parts |
| Ethylene-vinylacetate copolymer (EV-40Y, made by Mitsui Dupont Polychemical Co.) | 0.18 parts |
| Magenta pigment dispersion (MHI 527, including surfactant, NV = 20 wt %, made by Mikuni Shikiso Co.) | 12.89 parts |
| Fluorine-containing surfactant (Megafack F-178K NV = 30, made by Dainihon Ink Chemical Co.) | 0.1 parts |
| Methyl ethyl ketone (MEK) | 30.23 parts |
| Cyclohexanone | 57.12 parts |

(Light-heat Converting Layer)

On the colorant layer was coated the following composition of a coating solution employing the wire bar and dried. The dry membrane thickness was 0.8 μm.

| A coating solution of the light-heat converting layer | |
|---|---|
| Polyvinyl alcohol (GL-05 NV = 100, made by Nihon Goseikagaku Co.) | 4.82 parts |
| Carbon black dispersion (SD-9020 NV = 40, made by Dainihon Ink Chemical Co.) | 5.34 parts |
| Perfluoroalkylethyleneoxide (Megafack F-142D NV = 100, made by Dainihon Ink Chemical Co.) | 0.04 parts |
| Distilled water | 71.2 parts |
| IPA (iso-propylalcohol) | 18.6 parts |

Employing each color pigment dispersion (yellow, cyan, black), the heat mode recording materials of four colors were produced. The composition of the colorant layer with every color is the same as the composition as shown in later mentioned Table 4.

(Preparing an Intermediate Transfer Material)

On the same 100 μm thick PET support as used for the above-mentioned heat mode recording material were coated a cushion layer, an intermediate layer and a receiving layer in this order.

(Cushion Layer)

On PET was coated the following composition of the coating solution employing the wire bar and dried. The dry membrane thickness was 35 um.

A coating solution of the cushion layer

Acryl latex (Yodosol AD105 NV=49%, made by Kanebo NSC CO.)

(Intermediate Layer)

On the cushion layer was coated the following composition of a coating solution employing the wire bar and dried. The dry membrane thickness was 1 μm.

| A coating solution of the intermediate layer | |
|---|---|
| Ethyl cellulose (STD 10 (PREM), made by Dow Chemical Co.) | 6.3 parts |
| IPA | 84.33 parts |
| MEK (methyl ethyl ketone) | 9.37 parts |

(Receiving Layer)

On the intermediate layer was coated the following composition of a coating solution employing the wire bar and dried.

| A coating solution of the receiving layer | |
|---|---|
| Acryl latex (Yodosol AD5805 NV = 55%, made by Kanebo NSC Co.) | 20.19 parts |
| Releasing material (FP-150 NV = 15%, made by Sumitomo Kagaku Co.) | 4.07 parts |
| PMMA (MX40S-2 NV = 25%, made by Soken Chemical Co.) | 1.95 parts |
| Pure water | 65.02 parts |
| IPA | 8.78 parts |

(Heat Mode Recording)

Heat mode recording (transfer) was carried out by using thus obtained recording material and intermediare transfer material. Exposure was carried out by a laser beam light of 830 nm and a laser power of 100 mW, employing a color decision exposure machine TCP-1080 (produced by Konica Co.). Each characteristic of the coating solution of the light-heat converting layer, coatability of the light-heat converting layer, transferability and exposing characteristics of the colorant layer and the light-heat converting layer were evaluated.

Surface Tension

The surface tension was measured with a platinum plate, employing PHW (produced by Kyowakaimen Kagaku Co.) by Wilhelmy method. Polar composition and nonpolar composition were calculated by using Young-Fowkes formula. When the calculated value for the nonpolar composition was negative, it was corrected.

Contact Angle

The contact angle was measured 60 seconds later just after a droplet was dropped onto the black colorant layer.

Viscosity

The viscosity was measured by employing vibration viscometer CJP, and the viscosity at $10^{-5}$ (1/s) was listed.

(Evaluation)

The following items were evaluated and obtained results were collectively listed in Table 1.

Coatability

A; No repellence point (repellence point was larger than 1 mm) of the light-heat converting layer to its under layer was not observed at all.

B; Not more than 3 repellence points per 100 $m^2$ (repellence point was larger than 1 mm) of the light-heat converting layer to its under layer were observed.

C; Not less than 4 repellence points per 100 $m^2$ (repellence point was larger than 1 mm) of the light-heat converting layer to its under layer were observed.

Transferability

The transferability of the colorant layer and light-heat converting layer from the temporary support to the support was evaluated according to the following criteria.

A; Both of the colorant layer and the light-heat converting layer were transferred.

B; The light-heat converting layer was transferred, but not more than 2 untransferred points per 10 $m^2$ of the colorant layer (untransferred point was larger than 1 mm) were observed.

C; The light-heat converting layer was transferred, but not less than 3 untransferred points per 10 $m^2$ of the colorant layer (untransferred point was larger than 1 mm) were observed.

Solid Sensitivity and Ablation Point

After exposure by the laser beam light, the recording material transferred to the intermediate transfer material was transferred to Tokubishi art paper (paper thickness of 127.9 g/$m^2$) at transferring temperature of 120° C. and laminating pressure of 4 kg/$cm^2$ employing a laminator TP-80 (produced by Konica Co.). In this way, solid sensitivity and ablation point were evaluated. It is preferred that the difference between the value of the solid sensitivity and that of the ablation point is larger.

Example 3 to 7

The recording material and the intermediate transfer material were prepared and evaluated in the same manner as employed in example 1 except replacing the surfactant by the surfactants listed in Table 2.

Example 8

The recording material and the intermediate transfer material were prepared and evaluated in the same manner as employed in example 1 except replacing the coating solution composition of the light-heat converting layer by such those as 2.14 parts of infrared ray absorbing dye (IR-1), 4.82 parts of gosenol EG-30, 0.04 parts of FT-251, 74.4 parts of pure water and 18.6 parts of IPA.

Example 9, 10 (Comparative Examples)

The recording material and the intermediate transfer material were prepared and evaluated in the same manner as employed in example 1 except replacing the surfactant by the surfactants listed in Table 2.

Example 11 (Comparative Example)

The recording material and the intermediate transfer material were prepared and evaluated in the same manner as employed in example 2 except a surfactant being not added in the light-heat converting layer.

TABLE 2

| Example No. | Surfactant | | Surface tention dyn/cm Polar component | Nonpolar component |
|---|---|---|---|---|
| 2 | Perfluoroalkylethyleneoxide | 1% | 26.36 | 0 |
| 3 | Fluorinated-alkylalkoxylate + Fluorinated-alkylsulfonaaide | 1% | 26.17 | 0 |
| 4 | α-perfluorononenyl-ω-methylpolyoxyethylene | 1% | 26.78 | 0 |
| 5 | Perfluoroalkylethyleneoxide | 2% | 23.66 | 0 |
| 6 | Fluorinated-alkylalkoxylate + Fluorinated-alkylsulfonamide | 2% | 23.22 | 0 |
| 7 | α-perfluorononenyl-ω-methylpolyoxyethylene | 2% | 23.34 | 0 |
| 8 | Perfluoroalkylethyleneoxide | 1% | 26.24 | 0 |
| 9 | Alkylarylpolyetherphosphate | 1% | 26.25 | 0 |
| 10 | Alkylalcoholpolyether condensed compound | 1% | 25.74 | 0 |
| 11 | — | | 28.41 | 4.99 |

| Example No. | Contact angle (°) | Viscosity cp | Coatability | Transferability rpm | Solid sensitivity rpm | Ablation point | Remarks |
|---|---|---|---|---|---|---|---|
| 2 | 48 | 457 | A | A | 530 | 440 | Inv. |
| 3 | 50 | 423 | A | A | 540 | 450 | Inv. |

TABLE 2-continued

| | | | | | | | |
|---|---|---|---|---|---|---|---|
| 4 | 45 | 502 | A | A | 540 | 440 | Inv. |
| 5 | 40 | 554 | B | A | 520 | 440 | Inv. |
| 6 | 40 | 632 | B | A | 530 | 450 | Inv. |
| 7 | 38 | 712 | B | A | 530 | 430 | Inv. |
| 8 | 47 | 438 | A | A | 520 | 440 | Inv. |
| 9 | 50 | 423 | A | A | 450 | 430 | Comp. |
| 10 | 51 | 389 | A | A | 410 | 370 | Comp. |
| 11 | 62 | 360 | C | C | 530 | 450 | Comp. |

Inv.: Invention, Comp.: Comparison

As can be seen from Table 2, the transferability of the light-heat converting type heat mode recording materials according to the present invention is excellent and the coatability of the light-heat converting layer is improved. Furthermore, using B used in example 1 as the intermediate transfer material, a similar experiment as employed in example 2 was carried out and a favorable result was obtained.

Example 12

[Preparation of an Intermediate Transfer Material]

(1-1) Preparing a Temporary Support

After a composition of releasing layer mentioned below was diluted with water and coated on a 25 μm thick polyethylene terephthalate (PET) film support (T-100, produced by Diafoil Hoechst Co.) and dried so that the dry coating weight was 0.3 g/m$^2$, the material obtained above was heat-treated at 120° C. for 1 minute, then cured at 60 ° C. for 36 hours.

| (Releasing layer composition) | |
|---|---|
| Polyvinyl alcohol (EG-30, made by Nihongosei Chemical Co., TGA50 thermally decomposition temperature is 376° C.) | 85 parts |
| Crosslinking agent (Sumirese Resin 613, made by Sumitomo Kagaku Co.) | 9 parts |
| Crosslinking accelerating agent (ACX-P, made by Sumitomo Kagaku Co.) | 1 part |
| Fluorine-containing compound (FP-150 made by Sumitomo Kagaku Co.) | 5 parts |

(1-2) Preparing an Ink Layer

On the releasing layer coated on the temporary support prepared in (1-1) was coated a later mentioned ink layer composition which was dissolved in a mixed solvent of methyl ethyl ketone and anone, so that coating weight is 0.48 g/m$^2$.

| (Ink layer composition) | |
|---|---|
| Yellow pigment dispersion (MHI-340, made by Mikuni Shikiso Co., solid content of the components including dispersion auxiliary compound is 10 wt %) | 12.77 parts |
| Styreneacryl resin (SBM-73F, made by Sanyo Kasei Co.) | 3.12 parts |
| Ethylene-vinylacetate resin (EV-40Y, Mitsui Dupont Polychemical Co.) | 0.16 parts |
| Fluorine-containing surfactant (F-178K, made by Dainihon Ink Co., megafack solid content is 30 wt %) | 0.08 parts |
| MEK | 26.87 parts |
| Anone | 57.00 parts |

(1-3) Preparing a Light-heat Converting Layer

On the ink layer prepared in (1-2) was coated a later mentioned light-heat converting layer composition which was dissolved in a mixed solvent of water and isopropyl alcohol (IPA)=3.8:1, so that the dry coating weight is 0.65 g/m$^2$. At this time, the absobance at wavelength of 830 nm was 0.729.

| (Light-heat converting layer composition) | |
|---|---|
| Carbon black dispersion (SD-9020, made by Dainihon Ink Co., solid content is 40%) | 60.67 parts |
| Polyvinyl alcohol (EG-30, described previously) | 45.38 parts |
| Fluorine-containing surfactant (FT-251, made by Neos Co., solid content is 100%) | 0.35 parts |
| Water:IPA = 707.60 parts:186.00 parts | |

(1-4) Preparing a Back Coat Layer for a Support

After a composition of back coat layer mentioned below was diluted with water and coated on a 100 μm thick PET film support (T-100 described previously) and dried so that the dry coating weight was 0.3 g/m$^2$, the material obtained above was heat-treated at 120° C. for 1 minute, then cured at 60° C. for 36 hours.

| (Back coat layer composition) | |
|---|---|
| Polyvinyl alcohol (EG-30, described previously) | 85.00 parts |
| Crosslinking agent (Sumirese Resin 613, described previously) | 9.00 parts |
| Crosslinking accelerating agent (ACX-P, described previously) | 1.00 part |
| Fluorine-containing compound (FP-150, described previously) | 5.00 parts |
| Matting agent (3 μm silica particles) | 5.00 parts |

(1-5) Preparing a Cushion Layer

On the opposite side of the support to the back coat layer prepared in (1-4) was coated a later mentioned cushion layer composition which was dissolved in a mixed solvent of methyl ethyl ketone:toluene=1:4, so that the dry coating membrane thickness was 7 ρm.

| (Cushion layer composition) | |
|---|---|
| Styrene type rubber (Craton G1657, made by Shell Co.) | 70 parts |
| Tackifier (Super Ester A100, made by Arakawa Chemical Co.) | 30 parts |

(1-6) Adhesion of the Cushion Layer and the Light-heat Converting Layer

The surface of the cushion layer prepared in (1-5) and the surface of the light-heat converting layer prepared in (1-3) were laminated at a line pressure of 25.2 kg/cm.

(1-7) Removing the Temporary Support

By peeling off and removing the temporary support from the laminated sheet prepared in (1-6) under a peeling condition as shown in FIG. 1, finally the recording material consisting of back coat layer/support/cushion layer/light-heat converting layer/ink layer was obtained.

The prescription of the light-heat converting layer was changed as shown in the following Table 3. Hereon, part is weight part.

TABLE 3

| | SD9020 part | EG30 part | FT-251 part | Water part | IPA part | 830 nm absorbance |
|---|---|---|---|---|---|---|
| A | 60.67 | 45.38 | 0.35 | 707.60 | 186.00 | 0.729 |
| B | 56.00 | 47.25 | 0.35 | 707.60 | 186.00 | 0.673 |
| C | 51.33 | 49.12 | 0.35 | 707.60 | 186.00 | 0.617 |
| D | 46.67 | 50.98 | 0.35 | 707.60 | 186.00 | 0.561 |

The prescription of the ink layer was changed as shown in the following Table 4. Hereon, part is weight part.

TABLE 4

| | Pigment dispersion part | SBM-73F part | EV-40Y part | F-178K part | MEK part | Anone part | Coating weight ($g/m^2$) |
|---|---|---|---|---|---|---|---|
| Y | 12.77 | 3.12 | 0.16 | 0.08 | 26.87 | 57.00 | 0.48 |
| M | 12.89 | 2.71 | 0.18 | 0.10 | 30.23 | 57.12 | 0.60 |
| C | 3.41 | 3.27 | 0.21 | 0.08 | 26.32 | 66.71 | 0.56 |
| K | 5.82 | 3.69 | 0.25 | 0.10 | 24.34 | 65.80 | 0.74 |

M(magenta): magenta pigment dispersion (made by Mikuni Shikiso Co., MHI-527 (solid content of the components including dispersion auxiliary compound is 20 wt %)).

C(cyan): cyan pigment dispersion (made by Mikuni Shikiso Co., MHI-454 (solid content of the components including dispersion auxiliary compound is 30 wt %)).

K(black): black pigment dispersion; mixture of 4.1 parts of MHI-220 made by Mikuni Shikiso Co., (solid content of the components including dispersion auxiliary compound is 30 wt %), 0.72 parts of MHI-454 described previously and 1 part of MHI-735 (solid content of the components including dispersion auxiliary compound is 10 wt %).

(Image Recording and Evaluation Method)

Using the above obtained intermediate transfer material, color decision receiving film CD-1R was exposed employing Konica EV-laser Proofer (laser oscilating wavelength is 830 nm, circumferential length is 29 inches) at illumination intensity of an exposed portion of 70 to 100 mW/1 ch and rotational rate of 400 to 600 rpm.

The supremum rotational rate where solid density is constant (solid sensitivity) and the supremum rotational rate where an image is stained by scattering of the light-heat converting layer (ablation point) were evaluated. However, in the case of black, the rotational rate where reflective density of not lower than 1.8 is obtained is to be the solid sensitivity range.

Sample 1

The light-heat converting layers shown in Table 5 were coated on each recording material of Y, M, C, K, and employing recording order shown in Table 5 the image recording was carried out. Obtained results are shown in Table 5.

TABLE 5

| Ink layer | Light-heat converting layer | Recording order | Illumination intensity of an exposed portion mW | Solid sensitivity rpm | Ablation point rpm |
|---|---|---|---|---|---|
| K | A | 1 | 100 | 510–600 | — |
| C | C | 2 | 100 | 550 | 430 |
| Y | C | 3 | 100 | 560 | 480 |
| M | C | 4 | 100 | 540 | 410 |

As can be seen from the obtained results, in cases where the recording method according to the present invention was employed, under the same exposing condition without any special establishment, a favorable latitude between the solid sensitivity and the ablation point was obtained, and an image with stable density and good dot gain were also obtained.

Sample 2

The light-heat converting layers shown in Table 6 were coated on each recording material of Y, M, C, K, and employing recording order shown in Table 6, the image recording was carried out. Obtained results were shown in Table 6.

TABLE 6

| Ink layer | Light-heat converting layer | Recording order | Illumination intensity of an exposed portion mW | Solid sensitivity rpm | Ablation point rpm |
|---|---|---|---|---|---|
| K | A | 1 | 100 | 510–600 | — |
| C | B | 2 | 100 | 540 | less than 400 |
| Y | D | 4 | 100 | 520 | 430 |
| M | C | 3 | 100 | 530 | 400 |

As can be seen from the obtained results, since preferable absorbance per unit coating weight of the light-heat converting layer was established against the recording material of each color and the image recording was carried out in recording order according to the method of the present invention, a larger ablation point latitude was obtained compared with sample 1, and an image with stable density and good dot gain were also obtained.

Sample 3

With respect to the following two colors, overall (A2+ size) solid recording was carried out. The light-heat converting layers shown in Table 7 were coated on each recording material, and employing recording order shown in Table 7, the image recording was carried out. Obtained results were shown in Table 7. In this experiment, an image defect was checked and evaluated by providing a protrusion having a thickness of 60 $\mu$m and a side of 2 mm on the surface of the drum.

TABLE 7

| Ink layer | Light-heat converting layer | Recording order | Illumination intensity of an exposed portion mW | Recording rotational rate rpm | Image defect |
|---|---|---|---|---|---|
| M | A | 1 | 100 | 530 | None |
| C | C | 2 | 100 | 520 | None |

As can be seen from the obtained results, since no image defect was observed in both magenta and cyan, an uniform blue image was obtained. In this case, it can be found that gas generated caused by the laser exposure is rapidly vacuumed so that close adhesion between the ink sheet and the receiving sheet is not interfered.

[Effects of the invention]

According to the present invention, the intermediate transfer material with improved peeling static charge and transportation property can be obtained. Specifically, the intermediate transfer material is the most suitable for heat mode recording method by which image recording is carried out by bringing the intermediate transfer material in close contact with the recording material, and static charge caused by transportation in a heat mode recording apparatus can be sufficiently prevented. Furthermore, electrostatic adsorption at teflon processed portion equipped at transportation guide for the prevention of abrasion mark can be prevented and transpotation trouble can be also prevented. Coatability of the light-heat converting layer of the thermal transfer image forming material is also improved. In cases where an image of plural colors is recorded, establishing a proper exposure condition is easy and a proper exposing condition range is wide, and uniformity of image density of each first color and second color is satisfied. Specifically, the intermediate transfer material of the present invention can obtain excellent transportation ability independently of thermal transfer method and kind of the thermal transfer image forming material, as long as the intermediate transfer material is used for transferring an image from it to the final recording material by thermal transfer after intermediate transfer of the image.

Disclosed embodiment can be varied by a skilled person without departing from the spirit and scope of the invention.

What is claimed is:

1. An intermadiate transfer material;

to which an image is transferred from a thermal transfer image forming material by thermal transfer;

which transfers said transferred image to a final support by thermal transfer; comprising:

a support and a receiving layer to which said image is transferred from said thermal transfer image forming material, wherein said intermediate transfer material comprises a back coat layer or a support of which surface specific resistance is more than $2\times10^9$ to not more than $10^{12}$ $\Omega/m^2$ under the relative humidity of not more than 80%.

2. Said intermediate transfer material of claim 1, wherein said intermediate transfer material comprises a heat-plasticized cushion layer between said support and said receiving layer, and thickness of said heat-plasticized cushion layer is not less than 15 $\mu$m.

3. Said intermediate transfer material of claim 1, wherein said receiving layer has protrusions of 2 to 5 $\mu$m, and said intermediate transfer material comprises a back coat layer on an opposite side to said receiving layer, and said back coat has protrusions of not less than 5 $\mu$m to not more than 15 $\mu$m.

4. Said intermediate transfer material of claim 1, wherein said receiving layer has the protrusions of 2 to 5 $\mu$m, and said intermediate transfer material comprises the back coat layer on an opposite side to said receiving layer, and a smooster value of said back coat layer is not more than 300 mmHg.

5. Said intermediate transfer material of claim 1, wherein the back coat layer, in said intermediate transfer material, of which surface specific resistance is more than $2\times10^9$ to not more than $10^{12}$ $\Omega/m^2$ under the relative humidity of not more than 80% contains metal fine particles.

6. Said intermediate transfer material of claim 1, wherein the backing coat layer, in said intermediate transfer material, of which surface specific resistance is more than $2\times10^9$ to not more than $10^{12}$ $\Omega/m^2$ under the relative humidity of not more than 80% contains at least one of carbon black fine particles, graphite fine particles and tin oxide fine particles.

7. Said intermediate transfer material of claim 1, wherein said thermal transfer is a laser thermal transfer.

8. A thermal transfer image forming material in which an image is transferred by thermal transfer comprising:

a support, an ink layer and a light-heat converting layer between said ink layer and said support, wherein said light-heat converting layer contains 5 to 60 wt % of a light-heat converting agent and 0.01 to 10 wt % of a fluorine containing surfactant, when total weight of said light-heat converting layer represents 100 wt %.

9. Said thermal transfer image forming material of claim 8, wherein said fluorine containing surfactant contains a nonionic perfluorocarbon group.

10. Said thermal transfer image forming material of claim 8, wherein said thermal transfer is a laser thermal transfer.

11. Said thermal transfer image forming material of claim 8, wherein said light-heat converting agent is a near infrared ray absorbing dye of which absorbance is 0.5 to 1.5 at 830 nm.

12. Said thermal transfer image forming material of claim 8, wherein said near infrared ray absorbing dye is a carbon black.

13. Said thermal transfer image forming material of claim 8, wherein surface tension of a non-polar component of a coating solution of said light-heat converting layer is not more than 28 dyn/cm, or the surface tension of a polar component of the coating solution of said light-heat converting layer is not more than 3 dyn/cm.

14. Said thermal transfer image forming material of claim 8, wherein contact angle measured 60 seconds later after coating of a coating solution of said light-heat converting layer to an under layer of said light-heat converting layer is not more than 55°.

15. Said thermal transfer image forming material of claim 8, wherein viscosity of said coating solution of said light-heat converting layer at shear rate of $10^{-5}$ (1/s) is not less than 400 cp.

16. Said thermal transfer image forming material of claim 8, wherein said thermal transfer image forming material contains a cushion layer.

17. A thermal transfer recording material set comprising:

(i) at least two thermal transfer image forming materials comprising:

supports, ink layers and light-heat converting layers between said ink layers and and said supports;

(ii) an intermediate transfer material, to which an image is transferred from said thermal transfer image forming material by thermal transfer; which transfers said transferred image to a final support by thermal transfer; comprising:

a support and a receiving layer to which said image is transferred from said thermal transfer image forming materials, wherein said at least two thermal transfer image forming materials contain said ink layers having different colors, and wherein said intermediate transfer material comprises a back coat layer or a support of which surface specific resistance is more than $2\times10^9$ to not more than $10^{12}$ $\Omega/m^2$ under the relative humidity of not more than 80%.

18. Said thermal transfer recording material set of claim 17, wherein said light-heat converting layer contains 5 to 60 wt % of a light-heat converting agent and 0.01 to 10 wt % of a fluorine containing surfactant, when total weight of said light-heat converting layer represents 100 wt %.

19. Said thermal transfer recording material set of claim 17, wherein in said at least two thermal transfer image forming materials containing said ink layers having different colors, absorption of a laser beam light of said light-heat converting layers of said thermal transfer image forming materials is different.

20. Said thermal transfer recording material set of claim 19, wherein one of said at least two thermal transfer image forming materials each composed of said ink layers having different colors is a thermal transfer image forming material composed of the ink layer of black, and other is a thermal transfer image forming material composed of the ink layer of color other than black; absorbance of said laser beam light of said light-heat converting layer of said thermal transfer image forming material composed of the ink layer of black is larger than that of said light-heat converting layer of said thermal transfer image forming material composed of the ink layer of color other than black.

* * * * *